US009811042B2

(12) United States Patent
Nakamura et al.

(10) Patent No.: US 9,811,042 B2
(45) Date of Patent: Nov. 7, 2017

(54) IMAGE FORMING DEVICE, IMAGE FORMING SYSTEM, IMAGE DETECTING UNIT CORRECTING METHOD AND IMAGE DETECTING DEVICE

(71) Applicant: Konica Minolta, Inc., Chiyoda-ku, Tokyo (JP)

(72) Inventors: Mitsunori Nakamura, Tama (JP); Kazuomi Sakatani, Sagamihara (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/814,241

(22) Filed: Jul. 30, 2015

(65) Prior Publication Data

US 2016/0062296 A1 Mar. 3, 2016

(30) Foreign Application Priority Data

Aug. 27, 2014 (JP) ..... 2014-173244

(51) Int. Cl.
*G03G 15/00* (2006.01)

(52) U.S. Cl.
CPC ..... *G03G 15/6558* (2013.01); *G03G 15/5062* (2013.01); *G03G 2215/00945* (2013.01); *G03G 2215/00949* (2013.01)

(58) Field of Classification Search
CPC ..... G03G 15/043; G03G 15/0131; G03G 15/2039; G03G 15/161; G03G 15/1615; G03G 15/205; G03G 15/6558
USPC ..... 399/15
See application file for complete search history.

(56) References Cited

U.S. PATENT DOCUMENTS

2011/0182606 A1* 7/2011 Okanishi ..... G03G 15/1605 399/66
2012/0294635 A1* 11/2012 Yano ..... G03G 15/0189 399/39
2013/0161900 A1* 6/2013 Takahashi ..... B65H 7/06 271/228

FOREIGN PATENT DOCUMENTS

JP 2003-131538 A 5/2003
JP 2005-027276 A 1/2005
JP 2005-260305 A 9/2005
JP 2007-065297 A 3/2007
(Continued)

OTHER PUBLICATIONS

Office Action (Notice of Reasons for Rejection) dated Oct. 3, 2016, issued by the Japanese Patent Office in corresponding Japanese Patent Application No. 2014-173244, and English language translation of Office Action (12 pages).

*Primary Examiner* — Walter L Lindsay, Jr.
*Assistant Examiner* — Jessica L Eley
(74) *Attorney, Agent, or Firm* — Buchanan Ingersoll & Rooney PC

(57) ABSTRACT

An image forming device includes an image forming unit, a conveying unit, a first image detecting unit, a second image detecting unit, and a controller, wherein the controller includes a detecting unit correcting mode in which the first image detecting unit is corrected by using an image detection result by the second image detecting unit, and in the detecting unit correcting mode, a transfer paper conveying speed at the time of image reading by the second image detecting unit is changed to the transfer paper conveying speed different from a normal transfer paper conveying speed at the time of image formation and the first image detecting unit is corrected based on read results of the same image by the first and second image detecting units.

26 Claims, 17 Drawing Sheets

(56) References Cited

FOREIGN PATENT DOCUMENTS

| | | | |
|---|---|---|---|
| JP | 2010-66516 | A | 3/2010 |
| JP | 2014-92711 | A | 5/2014 |

* cited by examiner

IMAGE FORMING DEVICE, IMAGE FORMING SYSTEM, IMAGE DETECTING UNIT CORRECTING METHOD AND IMAGE DETECTING DEVICE

The entire disclosure of Japanese Patent Application No. 2014-173244 filed on Aug. 27, 2014 including description, claims, drawings, and abstract are incorporated herein by reference in its entirety.

BACKGROUND OF THE INVENTION

Field of the Invention

The present invention relates to an image forming device, an image forming system, an image detecting unit correcting method, and an image detecting device capable of detecting an image formed on transfer paper.

Description of the Related Art

An image is formed on transfer paper by an image forming unit based on image data in an image forming device such as a copying machine, a facsimile machine, a printer, a complex machine. The image is formed based on the image data according to a set image forming condition (image forming position, color, density and the like). The image forming condition might temporarily or gradually change according to operation of the image forming device, so that a quality is maintained by various types of automatic adjusting operation.

For example, an image patch and the like is formed on the transfer paper every predetermined time in which the image forming device operates or every predetermined number of printed sheets, this is read by a line sensor and the like and a state of the image and the image forming condition are compared to each other, and it is determined whether the image is appropriately formed. When the image is not correctly formed according to the image forming condition and displacement is generated, the quality of the image is maintained by correction of the image forming condition and the like.

JP 2003-131538 A suggests the image forming device provided with density detecting unit which detects density of a toner image while a transfer material is conveyed. In this device, a conveying speed of the transfer material is changed between normal image formation and toner image density detection, so that strength of the transfer material is stabilized, a distance between the density detecting unit and paper is always constant, and density detection accuracy is improved.

However, JP 2003-131538 A has a problem that the conveying speed of the transfer material is decreased when the density is detected, so that productivity is deteriorated.

A line sensor obtained by using a CCD, a CIS and the like is generally used as the sensor which detects the image density. The line sensor is suitable for high-speed reading and this may read the transfer paper on which fixing is performed at the conveying speed of a fixing unit to confirm color reproducibility and inspect a printing position. However, the line sensor is not excellent in color reproducibility, so that there is a problem that the image is not sufficiently detected, JP 2003-131538 A also has the similar problem. Therefore, a periodic correction by a spectral colorimeter and the like of which colorimetric accuracy is assured is considered.

When the line sensor is corrected by the spectral colorimeter in a configuration in which the spectral colorimeter and the line sensor are located on the same conveying path, it is required to read the patch on the same chart; however, optimal transfer paper conveying speeds are different between the line sensor and the spectral colorimeter. In general, the transfer paper is read at a higher conveying speed by the line sensor than the spectral colorimeter. It is required to make an integrated light amount per patch constant in the spectral colorimeter, so that it is required to make a patch length longer when the patch is read at the same conveying speed as that of the line sensor. However, when the patch length is made longer, the number of charts required for correction becomes larger and there is a problem that the number of sheets to be wasted in one correction becomes larger.

SUMMARY OF THE INVENTION

The invention of the present application has been made in view of the above-described circumstances, and a basic object thereof is to inhibit generation of the sheets to be wasted at the time of correction while improving image detection accuracy by correcting one image detecting unit by another image detecting unit.

To achieve the abovementioned object, according to an aspect, an image forming device reflecting one aspect of the present invention comprises: an image forming unit configured to form an image on transfer paper; a conveying unit configured to convey the transfer paper through a conveying path; a first image detecting unit configured to detect the image of the transfer paper on which the image is formed by the image forming unit conveyed by the conveying unit; a second image detecting unit formed of a detecting unit other than the first image detecting unit configured to detect the image of the transfer paper on which the image is formed by the image forming unit conveyed by the conveying unit; and a controller configured to control image formation and conveyance of the transfer paper and receive detection results of the first and second image detecting units, wherein the controller includes a detecting unit correcting mode in which the first image detecting unit is corrected by using an image detection result by the second image detecting unit, and in the detecting unit correcting mode, a transfer paper conveying speed at the time of image reading by the second image detecting unit is changed to the transfer paper conveying speed different from a normal transfer paper conveying speed at the time of image formation and the first image detecting unit is corrected based on read results of the same image by the first and second image detecting units.

According to the image forming device of Item. 2 of the present invention, in Item. 1, the controller preferably includes an image formation correcting mode in which an image forming condition by the image forming unit is amended by using at least the image detection result of the first image detecting unit.

According to the image forming device of Item. 3 of the present invention, in Item. 1 or 2, the controller preferably sets the transfer paper conveying speed at the time of the image reading by the first image detecting unit the same transfer paper conveying speed as the normal transfer paper conveying speed at the time of the image formation in an image formation correcting mode.

According to the image forming device of Item. 4 of the present invention, in any one of Items. 1 to 3, the image forming device preferably comprises a conveying speed changing unit configured to change the transfer paper conveying speed at the time of the image reading by the second image detecting unit.

According to the image forming device of Item. 5 of the present invention, in Item. 4, the conveying speed changing unit is preferably arranged downstream of the first image detecting unit on the conveying path, and the controller preferably changes the transfer paper conveying speed by the conveying speed changing unit before the second image detecting unit reads the image.

According to the image forming device of Item. 6 of the present invention, in Item. 4, the conveying speed changing unit is preferably arranged upstream of the first image detecting unit on the conveying path, and the controller preferably changes the transfer paper conveying speed by the conveying speed changing unit before the second image detecting unit reads the image.

According to the image forming device of Item. 7 of the present invention, in any one of Items. 1 to 6, the conveying unit preferably includes a circulation conveying path on a downstream side of the conveying path on which one or both of the first and second image detecting units are arranged, the circulation conveying path configured to return the transfer paper to an upstream side of the conveying path to convey, and the controller preferably executes control to convey the transfer paper through the circulation conveying path after reading the image by at least one of the first and second image detecting units on the conveying path and read the image by at least one of the first and second image detecting units which does not read the image.

According to the image forming device of Item. 8 of the present invention, in any one of Items. 1 to 7, the controller preferably reads the image of the transfer paper while changing a reading cycle of the first image detecting unit in the detecting unit correcting mode.

According to the image forming device of Item. 9 of the present invention, in any one of Items. 1 to 8, the controller preferably thins out read data by the first image detecting unit in the detecting unit correcting mode.

According to the image forming device of Item. 10 of the present invention, in any one of Items. 1 to 9, the first image detecting unit is preferably arranged upstream of the second image detecting unit on the path on which the transfer paper is conveyed.

According to the image forming device of Item. 11 of the present invention, in any one of Items. 1 to 9, the first image detecting unit is preferably arranged downstream of the second image detecting unit on the path on which the transfer paper is conveyed.

According to the image forming device of Item. 12 of the present invention, in anyone of Items. 1 to 11, the first image detecting unit is preferably a line sensor.

According to the image forming device of Item. 13 of the present invention, in any one of Items. 1 to 12, the second image detecting unit is preferably a spectral colorimeter.

To achieve the abovementioned object, according to an aspect, an image forming system reflecting one aspect of the present invention comprises an image forming unit configured to form an image on transfer paper; a conveying unit configured to convey the transfer paper through a conveying path; a first image detecting unit configured to detect the image of the transfer paper on which the image is formed by the image forming unit conveyed by the conveying unit; a second image detecting unit formed of a detecting unit other than the first image detecting unit configured to detect the image of the transfer paper on which the image is formed by the image forming unit conveyed by the conveying unit; and a controller configured to control image formation and conveyance of the transfer paper and receive detection results of the first and second image detecting units, wherein the controller includes a detecting unit correcting mode in which the first image detecting unit is corrected by using an image detection result by the second image detecting unit, and in the detecting unit correcting mode, a transfer paper conveying speed at the time of image reading by the second image detecting unit is changed to the transfer paper conveying speed different from a normal transfer paper conveying speed at the time of image formation and the first image detecting unit is corrected based on read results of the same image by the first and second image detecting units.

According to the image forming system of Item. 15 of the present invention, in Item. 14, the controller preferably includes an image formation correcting mode in which an image forming condition by the image forming unit is amended by using at least the image detection result of the first image detecting unit.

According to the image forming system of Item. 16 of the present invention, in Item. 14 or 15, the controller preferably sets the transfer paper conveying speed at the time of the image reading by the first image detecting unit the same transfer paper conveying speed as the normal transfer paper conveying speed at the time of the image formation in an image formation correcting mode.

To achieve the abovementioned object, according to an aspect, an image detecting unit correcting method reflecting one aspect of the present invention comprises: an image forming step of forming an image on transfer paper; a first image detecting step of detecting the image of conveyed transfer paper by a first image detecting unit; a second image detecting step of detecting the image of the conveyed transfer paper by a second image detecting unit; a conveying speed changing step of changing a conveying speed of the transfer paper conveyed at the second image detecting step to the transfer paper conveying speed different from a normal transfer paper conveying speed at the time of image formation; and a detecting unit correcting step of correcting the first image detecting unit based on read results of the same image at the first and second image detecting steps.

To achieve the abovementioned object, according to an aspect, an image detecting device connected downstream of an image forming device in a transfer paper conveying direction, the image detecting device reflecting one aspect of the present invention comprises: a conveying unit configured to convey transfer paper on which an image is formed conveyed from the image forming device through a conveying path; at least a second detecting unit out of a first image detecting unit configured to detect the image of the transfer paper conveyed by the conveying unit and the second image detecting unit formed of a detecting unit other than the first image detecting unit configured to detect the image of the transfer paper conveyed by the conveying unit; a conveying speed changing unit configured to change a transfer paper conveying speed when the second image detecting unit reads the image; and a detecting device controller configured to control the conveying speed changing unit, wherein the detecting device controller changes the transfer paper conveying speed when the second image detecting unit reads the image to the transfer paper conveying speed different from a normal transfer paper conveying speed in the image forming device.

According to the image detecting device of Item. 19 of the present invention, in Item. 18, the detecting device controller preferably changes the transfer paper conveying speed in response to an instruction of a controller provided on the image forming device.

According to the image detecting device of Item. 20 of the present invention, in Item. 18 or 19, the image detecting device preferably comprises a detecting device communicating unit configured to communicate with the image forming device, and the detecting device controller preferably transmits an image detection result by at least the second image detecting unit out of the first and second image detecting units obtained by the image detecting device to the image forming device through the detecting device communicating unit.

According to the image detecting device of Item. 21 of the present invention, in any one of Items. 18 to 20, the image detecting device is preferably connected to the image forming device provided with the first image detecting unit.

According to the image detecting device of Item. 22 of the present invention, in any one of Items. 18 to 20, the image detecting device preferably comprises the first image detecting unit, and the detecting device controller preferably corrects the first image detecting unit based on image read results of the same image by the first and second image detecting units.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described with reference to the drawings. However, the scope of the invention is not limited to the illustrated examples.

First Embodiment

Figure 1:
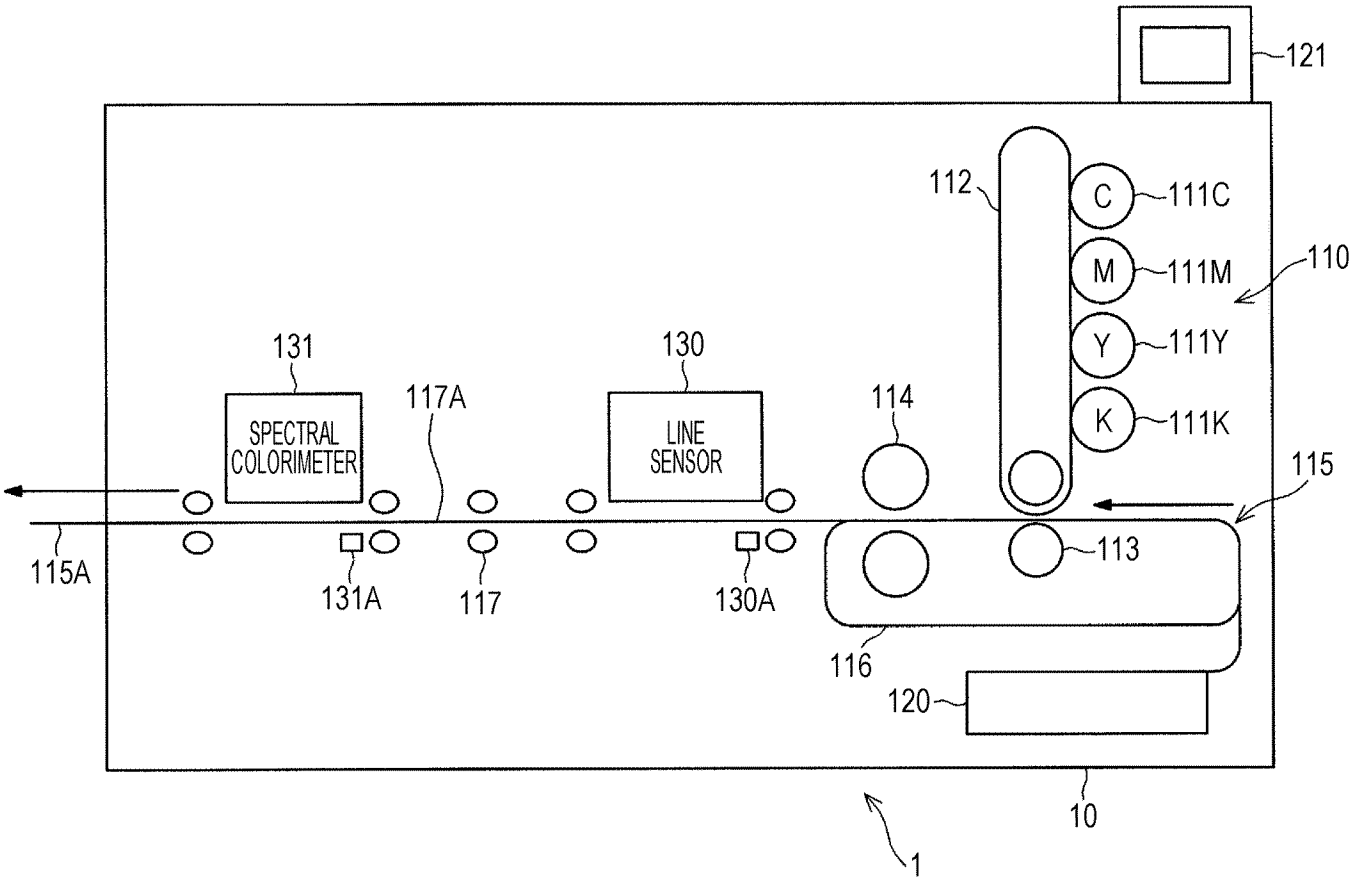
FIG. 1 is a view illustrating a mechanical outline of an image forming system of one embodiment of the present invention.

FIG. 1 illustrates an image forming system 1. Meanwhile, the image forming system 1 may be formed only of an image forming device 10, or the image forming device 10 and another device may be connected to each other to form the image forming system 1.

The image forming device 10 includes an image forming unit 110 which forms an image on transfer paper. The image forming unit 110 includes photoreceptors 111C, 111M, 111Y, and 111K (hereinafter, referred to as a photoreceptor 111 if generally referred to) prepared for respective colors (such as cyan, magenta, yellow, and black) in which a charger, a writing unit formed of a LD, and a developing unit not illustrated are arranged for each color on a circumference of each of the photoreceptors 111C, 111M, 111Y, and 111K; image exposure is performed by the writing unit on a surface of the photoreceptor 111 charged by the charger based on original copy image information recorded in an image memory and the like, and a latent image is formed on the surface of the photoreceptor 111. The latent image is developed by the developing unit to be a toner image. The toner image is transferred to an intermediate transfer belt 112 to be transferred from the intermediate transfer belt 112 to the transfer paper conveyed through a conveying path 115 by a secondary transfer roller 113. The conveying path 115 extends to a paper ejecting path 115A outside the device.

The transferred transfer paper is subjected to thermal fixing by a fixing device 114 and conveyed through the conveying path 115. Meanwhile, a monochrome device may be used for forming the image in the present invention, or a special color (such as clear) may be used in addition to the above-described colors.

A reversing conveying path 116 which reverses the transfer paper on which the image is formed and circulates the same to an upstream side of the image forming unit 110 is branched from the conveying path 115 downstream of the fixing device 114.

A paper feeding tray 120 in which the transfer paper is accommodated is arranged on a lower side of the image forming device 10. The conveying path 115 extends from the paper feeding tray 120 to the image forming unit 110 and further extends from the image forming unit 110 to the paper ejecting path 115A. The transfer paper may be a medium such as an OHP sheet and cloth in addition to paper.

The transfer paper accommodated in the paper feeding tray 120 is fed to be conveyed to the secondary transfer roller 113 through the conveying path 115. A color image or a monochrome image on the intermediate transfer belt 112 is transferred to the transfer paper by the secondary transfer roller 113. The transfer paper to which the image is transferred is subjected to heat and pressure by the fixing device 114, so that the toner image on the transfer paper is fixed.

Furthermore, a line sensor 130 which reads the image on an upper surface of the transfer paper is arranged above the conveying path 115 downstream of a point at which the reversing conveying path 116 is branched from the conveying path 115. The line sensor 130 may be formed of an imaging device such as a CCD and a CIS and is desirably formed to be longer than a width of the transfer paper conveyed through the conveying path 115. The line sensor 130 corresponds to a first image detecting unit of the present invention. It is only required that the first image detecting unit may detect the image of the transfer paper and a type thereof is not especially limited; this may also be a unit which reads in a planer manner or accumulates dot-like reading. A line sensor unit transfer paper detecting sensor 130A is located in a reading starting position of the line sensor 130 on the conveying path 115. The line sensor unit transfer paper detecting sensor 130A may be formed of an optical sensor and the like and may detect the paper.

A spectral colorimeter 131 which performs spectral colorimetry is arranged downstream of the line sensor 130 on the conveying path 115 to read a color of the image of the transfer paper conveyed through the conveying path 115. The spectral colorimeter 131 which applies illumination light to the transfer paper, receives light reflected on the image of the transfer paper by a sensor, disperses the received light, and represents components of the light, thereby quantifying the color may be used. A calorimetric unit transfer paper detecting sensor 131A is located in a reading starting position of the spectral colorimeter 131 on the conveying path 115. The colorimetric unit transfer paper detecting sensor 131A may be formed of an optical sensor and the like and may detect the paper.

A colorimetric unit conveying roller 117 is arranged downstream of the line sensor 130 and upstream of the spectral colorimeter 131. The colorimetric unit conveying roller 117 may decrease a conveying speed of the transfer paper conveyed downstream and assigns the conveying path after that to a colorimetric path 117A. That is to say, the colorimetric unit conveying roller 117 serves as a conveying speed changing unit of the present invention.

The image forming system 1 is provided with a controller 100. The controller 100 includes a CPU, a program which operates the same, a ROM which stores the program, a RAM which serves as a working area and the like, a non-volatile memory which stores an operation parameter and the like. The controller 100 which controls an entire image forming system receives read results of the image forming unit 110, the conveying path 115, and the line sensor 130. Meanwhile, the controller of the present invention may be provided on the image forming device 10, a server and the like.

Figure 2:
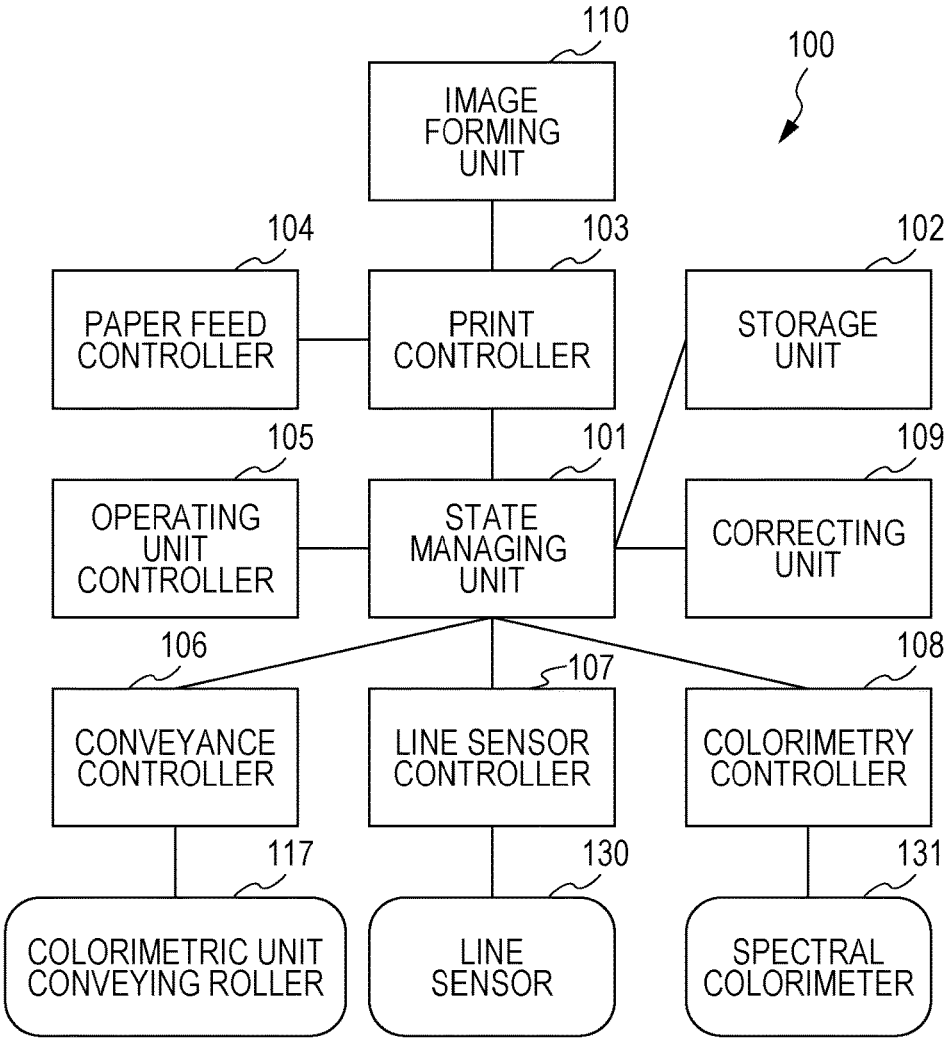
FIG. 2 is a functional block diagram of a controller according to one embodiment of the present invention.

FIG. 2 illustrates a functional block of the controller 100 and peripherals thereof.

A state managing unit 101 controls the entire image forming system 1 and grasps a state of the entire image forming system 1. A storage unit 102 is connected to the state managing unit 101. The storage unit 102 includes the ROM which stores the program and the like, the RAM which serves as the working area, the non-volatile memory such as a flash memory and a HDD which stores data in a non-volatile manner and the like. The non-volatile memory stores the operation parameter of the image forming system, an image formation correcting condition used when the image is corrected, a detecting unit correcting condition used when the image detecting unit is corrected, image patch data and the like so as to be readable/writable.

A print controller 103 is connected to the state managing unit 101. The image forming unit 110 is connected to the print controller 103 so as to be controllable. The print controller 103 forms the image on the transfer paper by controlling the image forming unit 110.

A paper feed controller 104 is connected to the state managing unit 101. The paper feed controller 104 controls the paper feeding tray 120 to feed the transfer paper to the conveying path 115.

An operating unit controller 105 is connected to the state managing unit 101. The operating unit controller 105 controls an operating unit 121 and obtains a content operated by the operating unit 121 to transmit to the state managing unit 101.

A conveyance controller 106 is connected to the state managing unit 101. The conveyance controller 106 controls a conveying unit which conveys the transfer paper fed from the paper feeding tray 120. The conveying unit is formed of the conveying path 115, the reversing conveying path 116, the conveying roller and the colorimetric unit conveying roller 117 to be described later on the conveying path, a motor which drives them and the like.

A line sensor controller 107 is connected to the state managing unit 101. The line sensor controller 107 controls operation of the line sensor 130 and receives the image data of the transfer paper read by the line sensor 130 to transmit to the state managing unit 101.

A colorimetry controller 108 is connected to the state managing unit 101 so as to be controllable. The colorimetry controller 108 controls operation of the spectral colorimeter 131 and obtains an image read result obtained by the spectral colorimeter 131 to transmit to the state managing unit 101.

A correcting unit 109 is connected to the state managing unit 101 so as to be controllable. The image read result by the line sensor 130 and an original copy read result by the spectral colorimeter 131 are provided from the state managing unit 101 to the correcting unit 109.

The correcting unit 109 obtains the image read result of the line sensor 130, compares an image forming condition and the read result, and performs correction such as amendment in the image formation as required in an image formation correcting mode. At that time, when the line sensor 130 is corrected according to the read result of the spectral colorimeter 131, a correction result is used.

The correcting unit 109 obtains the image read results by the line sensor 130 and the spectral colorimeter 131 of the same image of the same transfer paper and corrects the line sensor 130 as required regarding color reproducibility in the detecting unit correcting mode.

Basic operation of the image forming device 10 is next described.

In the image forming device 10, when a user performs operation to start printing from the operating unit 121, an external device and the like, an original copy reading unit not illustrated and the like obtains the image data. The image patch data is obtained from the storage unit 102 when the image formation correction or the detecting unit correction is started.

In the image forming unit 110, exposing unit forms an electrostatic latent image on the surface of the photoreceptor 111 uniformly charged based on generated image data by the control of the print controller 103. The formed electrostatic latent image is developed to be the toner image by the developing unit. The toner image formed on the surface of the photoreceptor 111 is primarily transferred to the intermediate transfer belt 112. Meanwhile, a method of obtaining the image data is not limited to the above; the data may also be obtained through a network.

According to the operation to start printing, the transfer paper loaded/accommodated in the paper feeding tray 120 is delivered (fed) to the conveying path 115 one by one to be conveyed. The transfer paper is conveyed to a contacting position with the secondary transfer roller 113 in synchronization with the toner image on the intermediate transfer belt 112.

The toner image on the intermediate transfer belt 112 is secondarily transferred to the transfer paper in a position of the secondary transfer roller 113. In secondary transfer, high positive transfer voltage is applied to the secondary transfer roller 113, so that the toner image which is negatively charged is attracted from the intermediate transfer belt 112 to the transfer paper in an electrostatic manner to be transferred. The toner image transferred to the transfer paper is fixed to transfer paper P by thermal melting by the fixing device 114 while being located on an upper surface side on the conveying path 115. Thereafter, the transfer paper is ejected downstream in a single-side printing mode.

In a both-side printing mode, the conveying path is switched and the transfer paper on which the image is formed is conveyed from the conveying path 115 to the reversing conveying path 116 to be reversed, and thereafter circulated to the conveying path 115 upstream of the secondary transfer roller 113. The transfer paper circulated to the conveying path 115 is reversed and the image transferred to the intermediate transfer belt 112 is transferred to a rear surface side of the image by the secondary transfer roller 113 in the above-described manner. Thereafter, the fixing device 114 may fix the image to the transfer paper and the paper may be conveyed downstream.

The image of the transfer paper conveyed through the conveying path 115 is read by the line sensor 130 in the image formation correcting mode or the detecting unit correcting mode. At that time, the line sensor 130 operates by the control of the line sensor controller 107 and the image of the transfer paper conveyed through the conveying path 115 is read. The read image is transmitted to the controller 100 to be used for the correction of the image formation or the correction of the line sensor 130.

When the spectral colorimeter 131 reads the image downstream of the line sensor 130, the conveyance controller 106 controls the colorimetric unit conveying roller 117 to change the conveying speed of the transfer paper so as to be lower than a normal conveying speed when the image is formed. The conveying speed after the change is set in advance based on an integrated light amount required by the spectral colorimeter and the like to be stored in the storage unit 102 in a non-volatile manner. The conveying speed may also be set by an operator through the operating unit 121. The changed transfer paper conveying speed and the normal transfer paper conveying speed are stored in the above-described manner in the storage unit 102.

The spectral colorimeter 131 operates by the control of the colorimetry controller 108 and the image of the transfer paper conveyed through the conveying path 115 is read. The read result is transmitted to the controller 100 to be used for the correction of the line sensor 130.

Meanwhile, it is also possible that operation timing is set in advance according to operating time of the device and the number of printed sheets and the image formation correction and the detecting unit correction are automatically executed according to the timing; it is also possible that the operator issues an instruction to execute through the operating unit 121.

Figure 3:
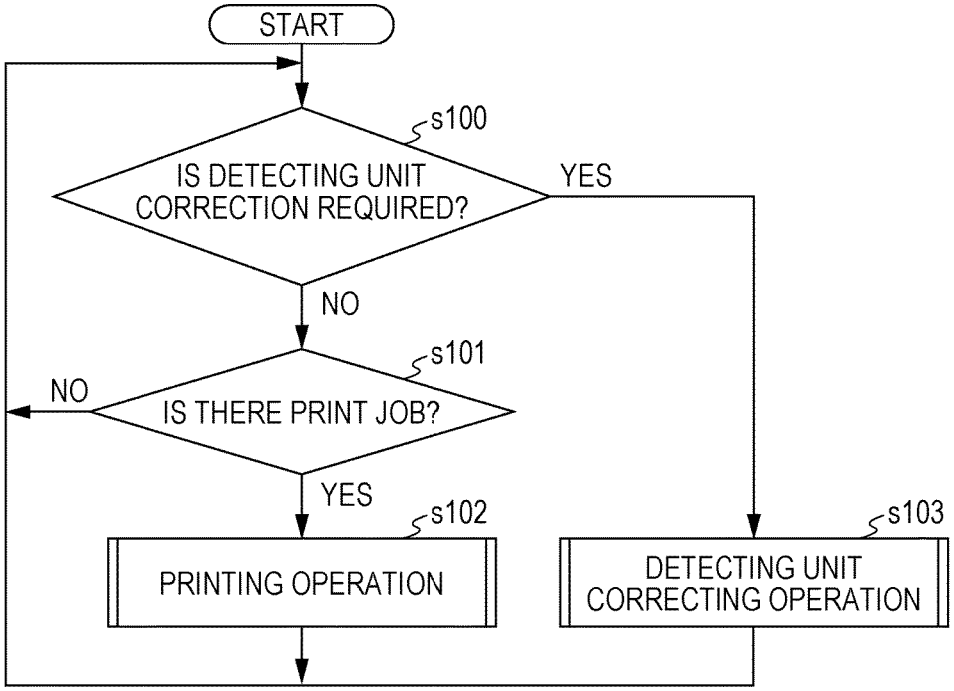
FIG. 3 is a flowchart illustrating an outline of a correcting procedure according to one embodiment of the present invention.

A processing procedure including the detecting unit correction is next described with reference to a flowchart in FIG. 3. Meanwhile, the following procedure is executed by the control of the controller 100.

s100: Detecting Unit Correction?

The process is started and it is determined whether the detecting unit correcting condition is satisfied (step s100). It is possible to determine whether the detecting unit correction is required by a condition determined in advance.

The detecting unit correction takes place under a condition as illustrated in Table 1, for example. There are the conditions set by the user by the operating unit such as settings Nos. 1 and 2 and the conditions generated when a device state is changed such as after maintenance of parts such as settings Nos. 3 and 4. It is possible to determine that the detecting unit correcting condition is satisfied if any condition is satisfied, and it is also possible that the user and the like sets a specific condition among a plurality of conditions through the operating unit 121.

TABLE 1

| CORRECTION STARTING CONDITION | | |
|---|---|---|
| SETTING No. 1 | CONDITION | CONDITION TYPE |
| 1 | NUMBER OF PRINTED SHEETS AFTER PREVIOUS LINE SENSOR CORRECTION IS COMPLETED >1000 | USER SETTING |
| 2 | ELAPSED TIME AFTER PREVIOUS LINE SENSOR CORRECTION IS COMPLETED >30 MINUTES | USER SETTING |
| 3 | FIRST OPERATION AFTER MAINTENANCE OF LINE SENSOR | MACHINE SETTING |
| 4 | FIRST OPERATION AFTER MAINTENANCE OF SPECTRAL COLORIMETER | MACHINE SETTING |

s101: Is there Print Job?

When the detecting unit correcting condition is not satisfied (No at step s100), the state managing unit 101 confirms whether a print job is received (step s101). When receiving the print job (Yes at step s101), this transmits a print request to the print controller 103.

s102: Printing Operation

At step s102, the state managing unit 101 sets an operating mode to a normal mode in response to the print request, and the print controller 103 executes printing based on the print job. The procedure at the time of printing is described later in detail.

s103: Correcting Operation

When the detecting unit correcting condition is satisfied (Yes at step s100), a detecting unit correcting request is transmitted to the correcting unit 109.

At step s103, the state managing unit 101 sets the operating mode to the detecting unit correcting mode in response to the detecting unit correcting request. The correcting unit 109 executes the correction of the line sensor. The procedure of the detecting unit correction is described later in detail.

Figure 4:
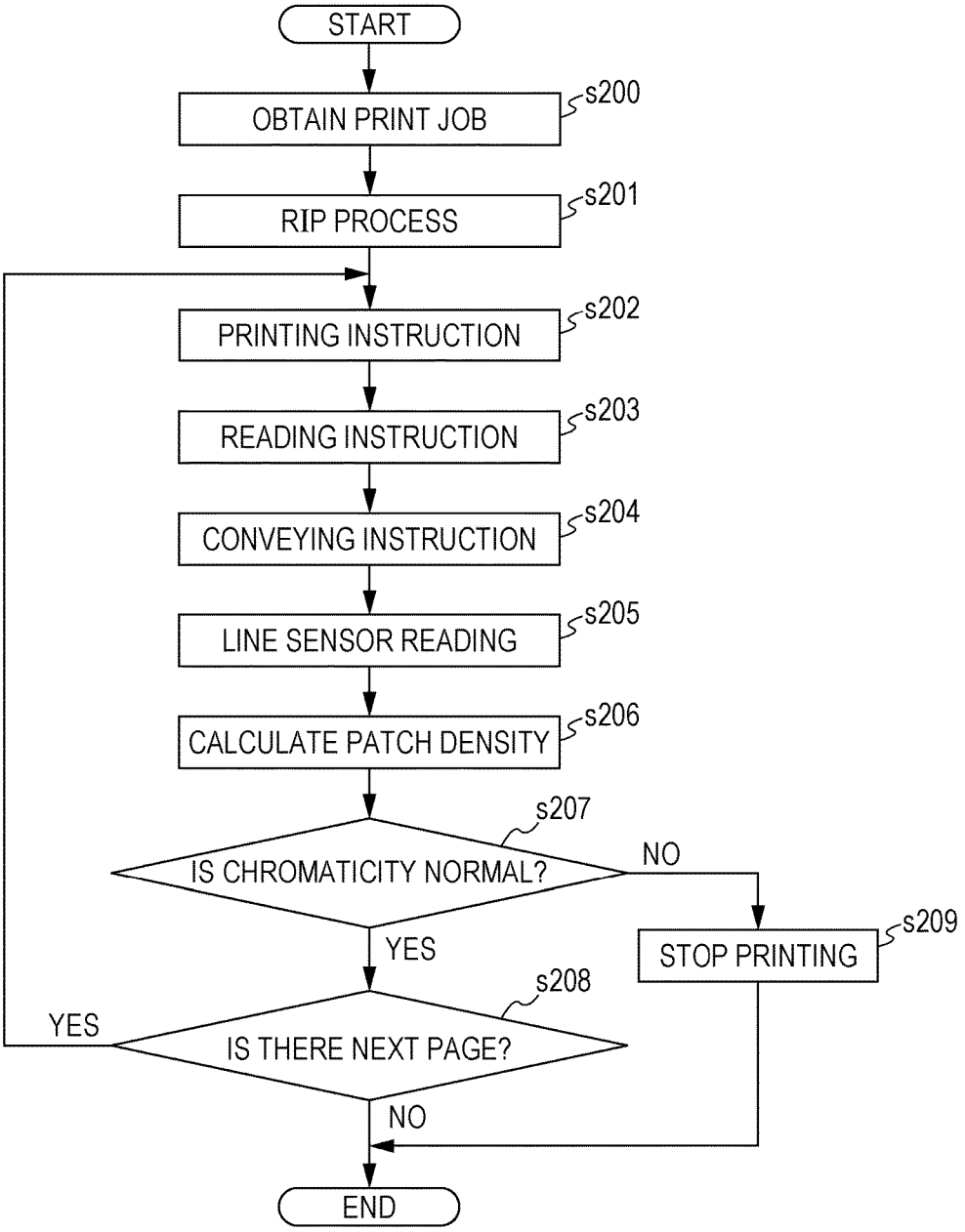
FIG. 4 is a flowchart illustrating a procedure of printing operation according to one embodiment of the present invention.

Next, the procedure at the time of printing is described with reference to a flowchart in FIG. 4. Meanwhile, the following procedure is executed by the control of the controller 100.

s200: Obtain Print Job

When a printing process starts, the print controller 103 receives the print request and the print job from the state managing unit 101 (step s200).

s201: RIP Process

When obtaining the print job, the print controller 103 performs a RIP process to generate a RIP image based on print job information (step s201). Furthermore, this may assign a patch for confirming color reproducibility to the RIP image. In the RIP image illustrated in FIG. 9, the patch is arranged on a left end outside cutting reference points indicated by four register marks. It is desirable to print the patch in a place to be cut and discarded after the fixing in order not to waste the transfer paper.

s202: Printing Instruction

After the RIP process, the print controller 103 instructs the image forming unit 110 to form the RIP image on the transfer paper as a printing instruction and instructs the paper feed controller 104 to start feeding the transfer paper (step s202). The image forming unit 110 transfers the image to the transfer paper by controlling the laser, the photoreceptor, the belt, the fixing unit and the like.

s203: Reading Instruction

After the printing instruction, the state managing unit 101 instructs the line sensor controller 107 to read the transfer paper by setting the operating mode to the normal mode (step 203).

s204: Conveying Instruction

After the reading instruction, the state managing unit 101 notifies the conveyance controller 106 that the operating mode is the normal mode and instructs the same to operate the conveying roller (step s204).

s205: Line Sensor Reading

The line sensor controller 107 reads the image of the transfer paper by the line sensor 130 based on the reading instruction and transmits the read image to the correcting unit 109 through the state managing unit 101 (step s205). At that time, the conveying speed of the transfer paper is the same as the conveying speed when the image is formed.

s206: Detect Patch Density

The correcting unit 109 detects the patch from the transfer paper read image by the line sensor 130 to calculate chromaticity of each patch (step s206).

s207: Chromaticity is Normal

The correcting unit 109 determines whether the chromaticity is of a normal value from a detection result of the patch (step s207). Supposed chromaticity is clear from the image forming condition and it is possible to compare the same with the detection result to determine whether the chromaticity is normal.

s208: Is there Next Page?

When the chromaticity is determined to be normal (Yes at step s207), the print controller 103 confirms whether there is a next page to be printed, that is to say, whether there is the next page with reference to the print job information (step s208). When there is the next page (Yes at step s208), the RIP process of the next page is started (to step s202). When there is no next page (No at step s208), the job is finished.

s209: Stop Printing

When the correcting unit 109 determines that the detected value is not normal (No at step s207), the correcting unit 109 notifies the state managing unit 101 of chromaticity abnormality, the state managing unit 101 stops printing (step s209) and finishes the job is finished.

When the printing is stopped, the state managing unit 101 instructs the print controller 103 to stop printing.

Meanwhile, when the chromaticity is abnormal, the state managing unit 101 may further display that the chromaticity abnormality is detected on the operating unit 121 for the user through the operating unit controller 105. At that time, it is desirable to display on the operating unit that the image forming unit is required to be corrected. Furthermore, it is desirable to display an image forming unit correction button to correct in response to a user instruction or to automatically correct the image forming unit when the chromaticity is abnormal.

Figure 5:
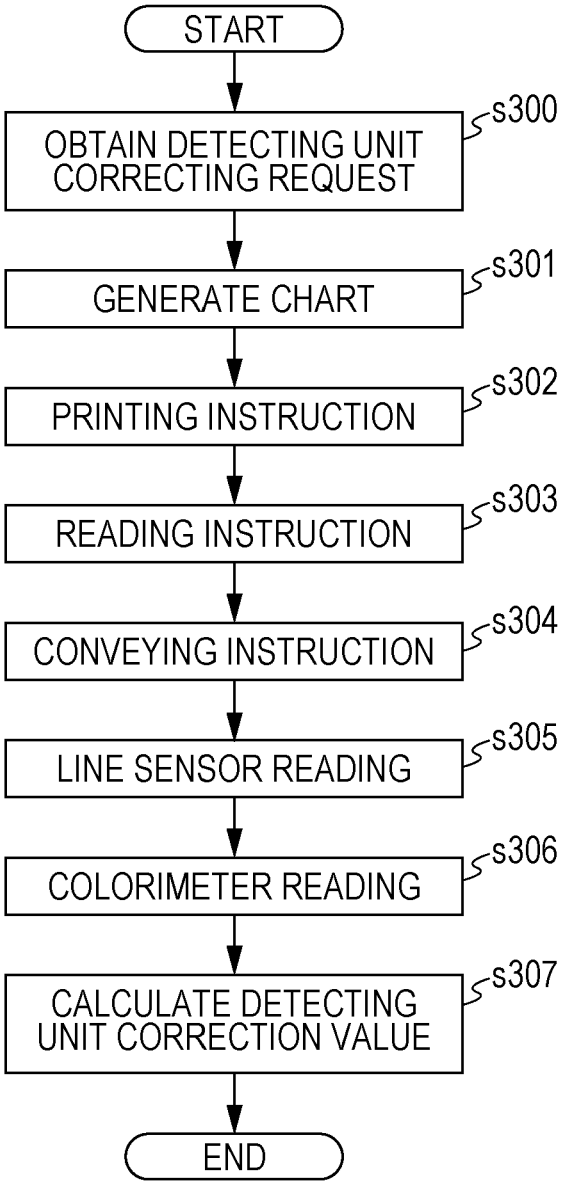
FIG. 5 is a flowchart illustrating a procedure of detecting unit correcting operation according to one embodiment of the present invention.

A procedure of the detecting unit correction is next described with reference to a flowchart in FIG. 5. Meanwhile, the following procedure is executed by the control of the controller 100.

s300: Obtain Correcting Request

When the detecting unit correcting procedure is started, the correcting unit 109 receives a line sensor correcting request from the state managing unit 101 (step s300).

s301: Generate Chart

After the correcting request is obtained (step s300), the state managing unit 101 transmits detecting unit correcting chart information held in the storage unit 102 to the print controller 103. The print controller 103 generates a detecting unit correcting chart image (step s301).

Figure 10:
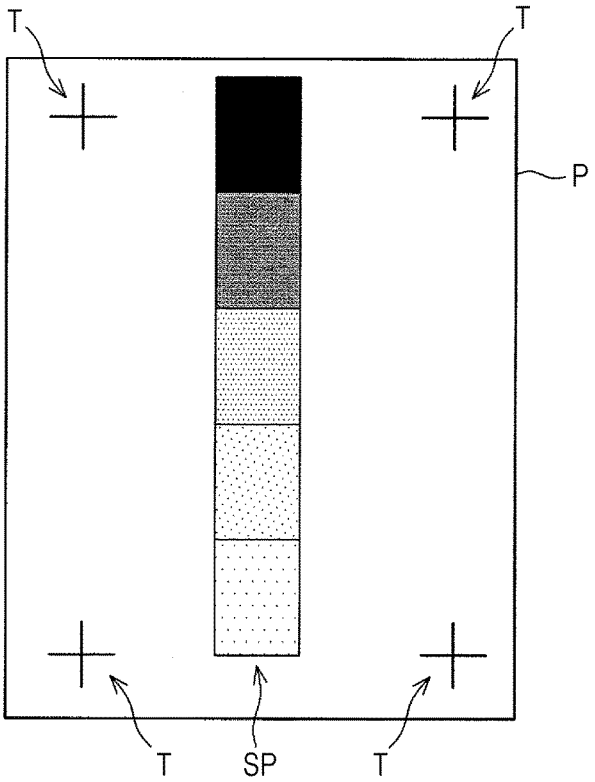
FIG. 10 is a view illustrating the transfer paper image at the time of detecting unit correction according to one embodiment of the present invention.
Figure 11:
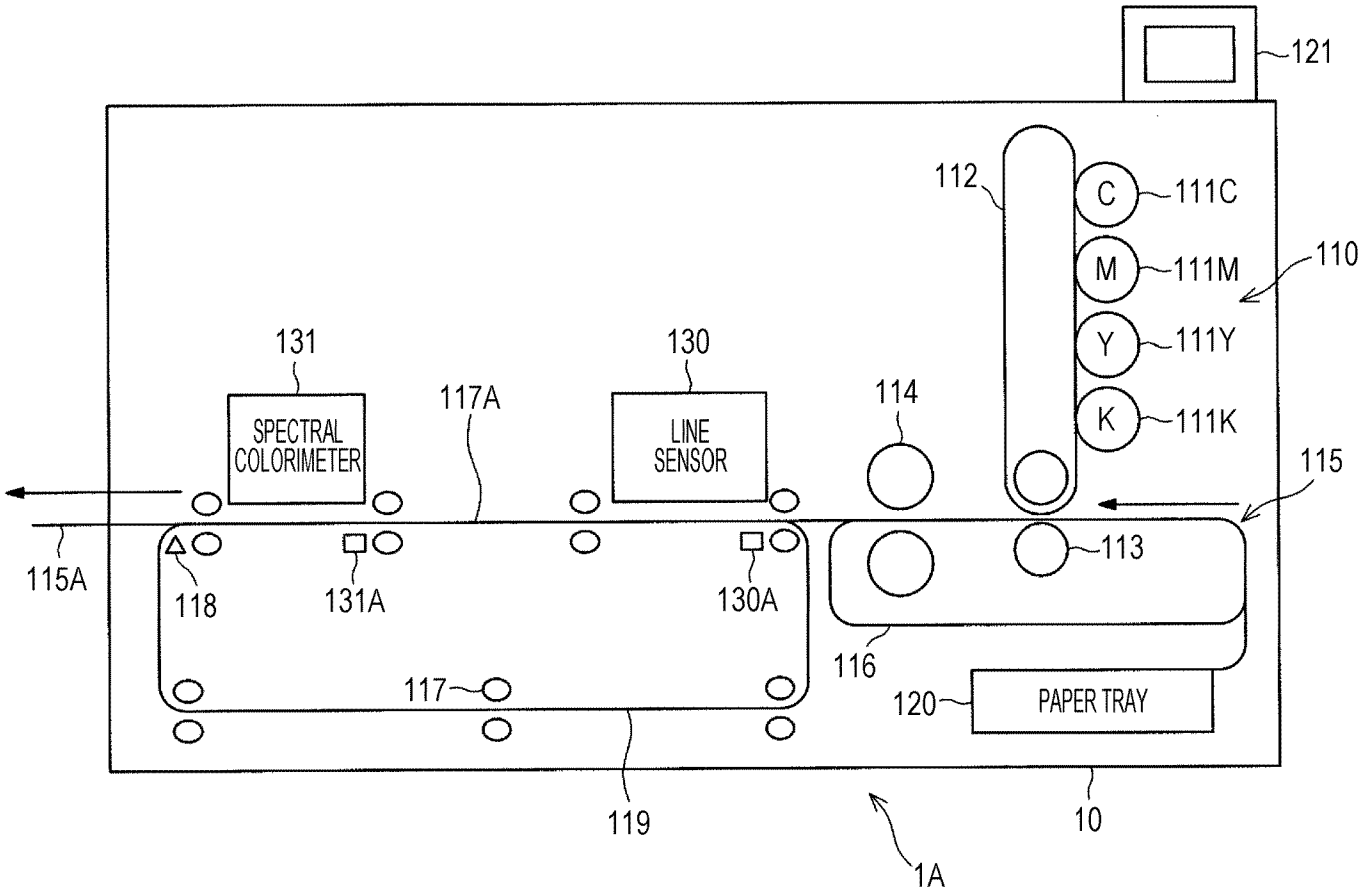
FIG. 11 is a view illustrating a changed example in which a circulating path is included in an image forming system according to another embodiment of the present invention.

The detecting unit correcting chart information in which a position and a place of the patch are recorded is illustrated in Table 2 and the detecting unit correcting chart is illustrated in FIG. 10.

Meanwhile, in the present invention, it is also possible to use a normal image formed on the transfer paper as the correcting chart without using the image patch.

TABLE 2

CORRECTING CHART INFORMATION

| PATCH No. | X POSITION (mm) | Y POSITION (mm) | WIDTH (mm) | HEIGHT (mm) | C DENSITY | M DENSITY | Y DENSITY | K DENSITY |
|---|---|---|---|---|---|---|---|---|
| 1 | 140 | 20 | 20 | 30 | 240 | 230 | 220 | 210 |
| 2 | 140 | 50 | 20 | 30 | 210 | 200 | 190 | 180 |
| 3 | 140 | 80 | 20 | 30 | 180 | 170 | 160 | 150 |
| 4 | 140 | 110 | 20 | 30 | 150 | 140 | 130 | 120 |
| 5 | 140 | 140 | 20 | 30 | 120 | 110 | 110 | 90 |

s302: Printing Instruction

After generating the correcting chart (step s301), the print controller 103 instructs the image forming unit 110 to print the chart image and instructs the paper feed controller 104 to start feeding the transfer paper (step s302).

The conveying speed in the image forming unit is the same as the normal speed also in the detecting unit correcting mode.

However, if a plurality of charts is required in the detecting unit correcting mode, the print controller 103 notifies the paper feed controller 104 to make an interval between the sheets larger than that in the normal mode by the length of time corresponding to deceleration for the reading by the spectral colorimeter 131.

s303: Reading Instruction

After the printing instruction (step s302), the state managing unit 101 instructs the line sensor controller 107 and the colorimetry controller 108 to read the chart image based on the detecting unit correcting chart information (step s303). According to this, the line sensor 130 and the spectral colorimeter 131 read the same image of the same transfer paper. At that time, the state managing unit 101 notifies the line sensor controller 107 that the operating mode is the detecting unit correcting mode.

s304: Conveying Instruction

The state managing unit 101 notifies the conveyance controller 106 that the operating mode is the detecting unit correcting mode (step s304). The conveyance controller 106 changes the conveying speed of the colorimetric unit conveying roller 117 to be lower than that in the normal mode.

s305: Line Sensor Reading

After the conveying instruction (step s304), the line sensor controller 107 reads the image including the patch formed on the transfer paper by the image forming unit 110 by the line sensor 130 and transmits the transfer paper image to the correcting unit 109 through the state managing unit 101 (step s305). The transfer paper conveying speed at that time is the same as the normal conveying speed.

s306: Colorimeter Reading

The colorimetry controller 108 reads each patch formed on the transfer paper by the image forming unit 110 by the spectral colorimeter 131, the transfer paper transmitted through the colorimetric path 117A at the conveying speed set to be lower than the normal speed by the colorimetric unit conveying roller 117 (step s306). A colorimetric value (such as L*a*b*/XYZ) of the patch is transmitted to the correcting unit 109 through the state managing unit 101. Device-independent L*a*b* and XYZ may be obtained by converting an RGB value and a CMYK value in a device-dependent color space by using a profile. The profile may be stored in the storage unit 102.

s307: Calculate Correction Value

The correcting unit 109 distinguishes each patch from the transfer paper image, detects the density (RGB/CMYK) of the patch, calculates a correction parameter for the line sensor 130 from the patch density and the colorimetric value of the spectral colorimeter 131 (step s307), and stores the same in the storage unit 102. Thereafter, the process is finished. It is possible to correct the line sensor 130 by using the correction value when reading by the line sensor 130 for the image formation correction at the normal time. Meanwhile, it is also possible to confirm correction accuracy by reading the chart again by the line sensor, the spectral colorimeter and the like for confirming a correction result.

In the above-described embodiment, the conveying speed of the line sensor 130 is the same in the detecting unit correcting mode and the normal mode, so that it is possible to correct under the same condition and the correction accuracy is improved. Meanwhile, although the transfer paper conveying speed is decreased between the line sensor 130 and the spectral colorimeter 131 in the above-described embodiment, it is also possible to decrease the same upstream of the line sensor 130 (to be described later). However, when the speed is decreased upstream of the line sensor 130, it is necessary to add a function to electrically thin out a read line or a function to change a reading cycle of the line sensor, so that it is desirable to decrease the speed between the line sensor and the spectral colorimeter.

Figure 6:
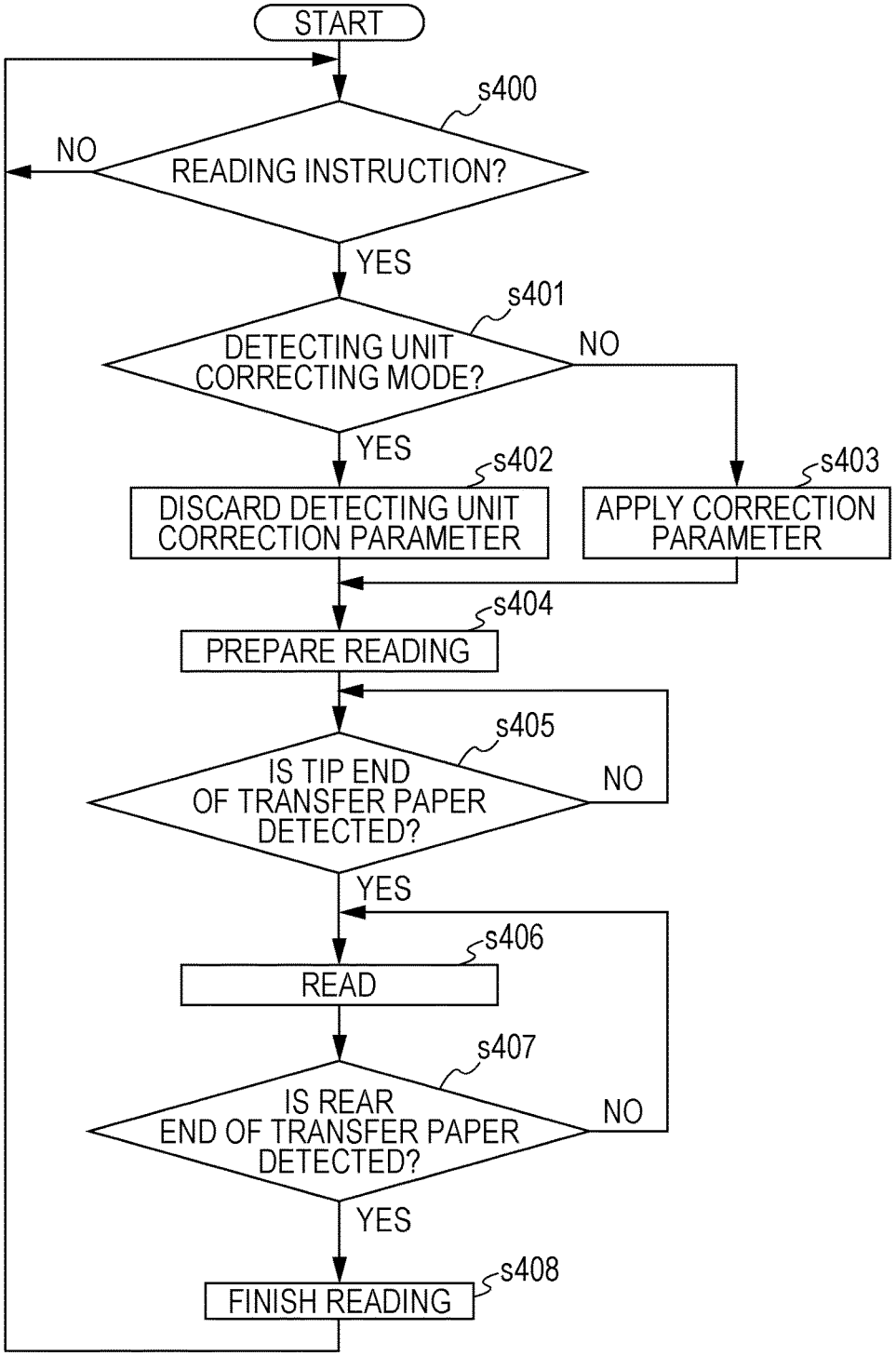
FIG. 6 is a flowchart illustrating a procedure of line sensor control according to one embodiment of the present invention.

A procedure in the line sensor controller is next described with reference to a flowchart in FIG. 6. Meanwhile, the following procedure is executed by the control of the controller 100.

s400: Is Reading Instruction Received?

The line sensor controller 107 determines whether there is the instruction to read the transfer paper from the state managing unit 101 when the control starts (step s400). When there is no reading instruction (No at step s400), this waits until this is instructed.

s401: Detecting Unit Correcting Mode?

When there is the reading instruction (Yes at step s400), the line sensor controller 107 determines whether a current operating mode is the detecting unit correcting mode from the reading instruction received from the state managing unit 101 (step s401).

It is switched whether to apply a detecting unit correction parameter according to the operating mode as illustrated in Table 3.

TABLE 3

| CORRECTION PARAMETER SETTING | |
|---|---|
| OPERATING MODE | CORRECTION PARAMETER APPLICATION |
| NORMAL | YES |
| CORRECTION | NO |

s402: Discard Correction Parameter

In the detecting unit correcting mode (Yes at step s401), the line sensor controller 107 is in the detecting unit correcting mode, so that this sets the line sensor 130 in a through mode in which the correction parameter is not applied (step s402).

s403: Apply Correction Parameter

If it is not in the detecting unit correcting mode (No at step s401), the line sensor controller 107 is in the normal mode, so that this reads the correction parameter from the storage unit 102 to apply to the line sensor 130 (step s403). The correction parameter is illustrated in Table 4.

TABLE 4

| CORRECTION PARAMETER (RGB LUT) | | | | | |
|---|---|---|---|---|---|
| INPUT R VALUE | OUTPUT R VALUE | INPUT G VALUE | OUTPUT G VALUE | INPUT B VALUE | OUTPUT B VALUE |
| 0 | 2 | 0 | 1 | 0 | 3 |
| 1 | 3 | 1 | 2 | 1 | 4 |
| 2 | 5 | 2 | 4 | 2 | 5 |
| 3 | 7 | 3 | 5 | 3 | 7 |
| . | . | . | . | . | . |
| . | . | . | . | . | . |
| . | . | . | . | . | . |
| 252 | 243 | 252 | 244 | 252 | 246 |
| 253 | 245 | 253 | 246 | 253 | 248 |
| 254 | 246 | 254 | 248 | 254 | 249 |
| 255 | 248 | 255 | 250 | 255 | 251 |

s404: Prepare Reading

After steps s402 and s403, the line sensor controller 107 prepares reading based on information such as a transfer paper size and a patch position received in the reading instruction from the state managing unit 101 (step s404).

s405: Is Tip End of Transfer Paper Detected?

After preparing reading (step s404), the line sensor controller 107 confirms whether the line sensor unit transfer paper detecting sensor 130A is turned ON (step s405). This waits until the sensor is turned ON (No at step s405), and when the sensor is turned ON (Yes at step s405), this determines that a tip end of the transfer paper is detected and shifts to a next process (step s406).

s406: Read

When the tip of the transfer paper is detected (Yes at step s405), the line sensor controller 107 reads the image of one line for each reading cycle (step s405).

s407: Is Rear End of Transfer Paper Detected?

After reading (step s406), the line sensor controller 107 confirms whether the line sensor unit transfer paper detecting sensor 130A is turned OFF (Yes at step s407). When the sensor is turned OFF, this determines that a rear end of the transfer paper is detected and shifts to a next process (step s408). When the sensor is not turned OFF (No at step s407), the controller waits for the detection (to step s406).

s408: Finish Reading

When the rear end of the transfer paper is detected (Yes at step s407), the line sensor controller 107 transmits the read image of the transfer paper to the correcting unit 109 through the state managing unit 101 and waits for the reading instruction (to step s400).

Figure 7:
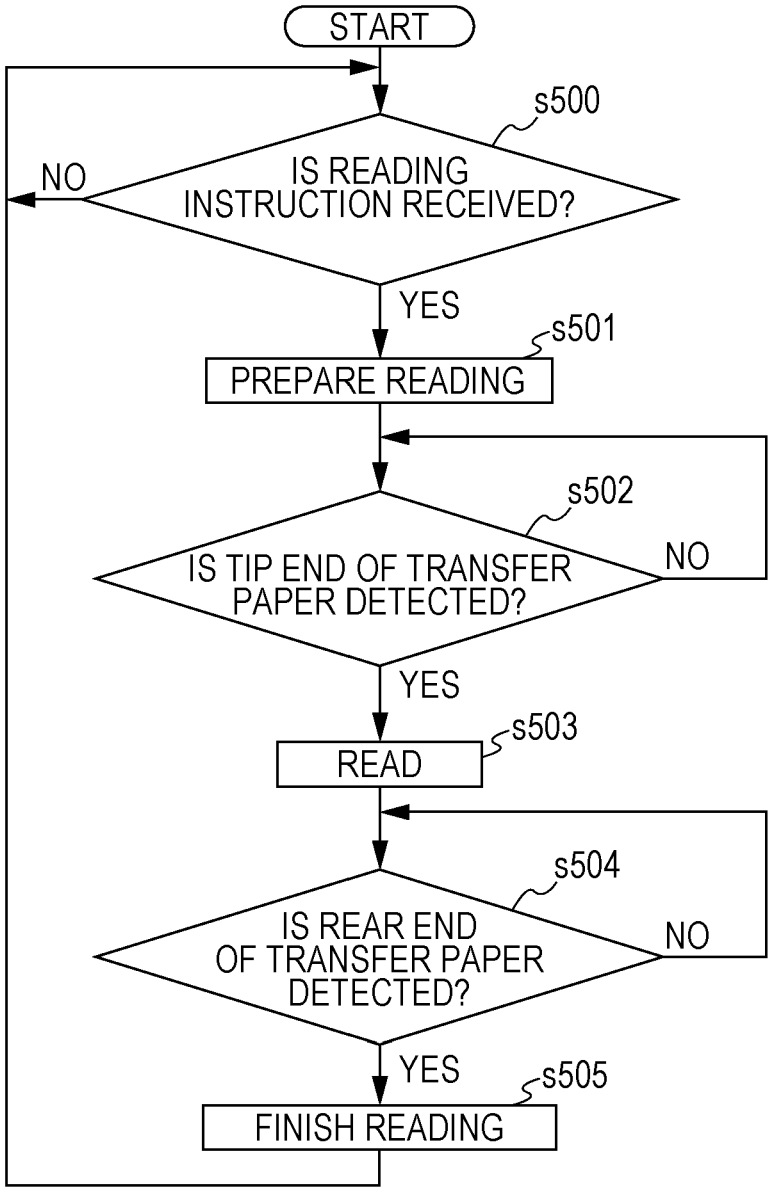
FIG. 7 is a flowchart illustrating a procedure of colorimeter control according to one embodiment of the present invention.

A procedure of the colorimetry controller is next described with reference to a flowchart in FIG. 7. Meanwhile, the following procedure is executed by the control of the controller 100.

s500: Is Reading Instruction Received?

The colorimetry controller 108 determines whether there is the instruction to read the transfer paper from the state managing unit 101 (step s500). When there is no reading instruction, this waits until the instruction is issued (No at step s500).

s501: Prepare Reading

When there is the reading instruction (Yes at step s500), the colorimetry controller 108 prepares reading based on the information such as the transfer paper size and the patch position received in the reading instruction from the state managing unit 101 (step s501).

s502: Is Tip End of Transfer Paper Detected?

After preparing reading, the colorimetry controller 108 confirms whether the colorimetric unit transfer paper detecting sensor 131A is turned ON (step s502). When the sensor is turned ON (Yes at step s502), this determines that the tip end of the transfer paper is detected and shifts to a next process. When the tip end of the transfer paper is not detected (No at step s502), this waits for the detection.

s503: Read

When the tip end of the transfer paper is detected (Yes at step s502), the colorimetry controller 108 starts the colorimetry when each patch position the reading instruction of which is issued comes (step s503).

s504: Is Rear End of Transfer Paper Detected?

The colorimetry controller 108 confirms whether the colorimetric unit transfer paper detecting sensor 131A is turned OFF. When the sensor is turned OFF, this determines that the rear end of the transfer paper is detected and shifts to a next process (step s505). When the sensor is not turned OFF (No at step s504), this waits for the detection.

s505: Finish Reading

After the rear end of the transfer paper is detected (step s504), the colorimetry controller 108 transmits the colorimetric value of each patch the reading instruction of which is issued to the correcting unit 109 through the state managing unit 101 and waits for the reading instruction (to step s500).

Figure 8:
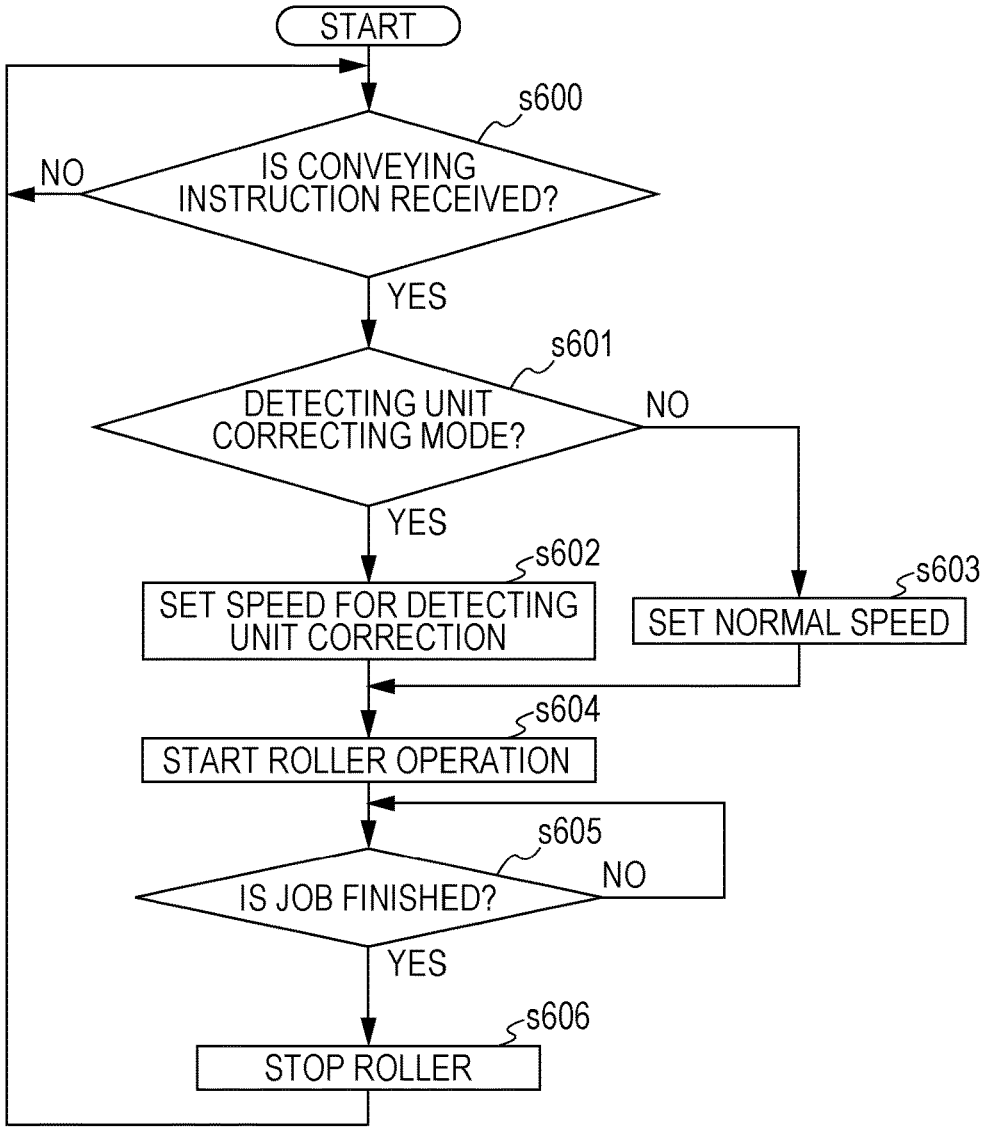
FIG. 8 is a flowchart illustrating a procedure of conveyance control according to one embodiment of the present invention.

A controlling procedure of the conveyance controller is next described with reference to a flowchart in FIG. 8. Meanwhile, the following procedure is executed by the control of the controller 100.

s600: Is Conveying Instruction Received?

The conveyance controller 106 determines whether an instruction to feed the transfer paper is received from the state managing unit 101 when conveyance control starts (step s600). When there is no conveying instruction (No at step s600), this waits until this is instructed.

s601: Correcting Mode?

After receiving the conveying instruction (Yes at step s600), the conveyance controller 106 determines whether the current operating mode is the correcting mode from the instruction to feed the paper received from the state managing unit 101.

s602: Set Speed for Correction

In the detecting unit correcting mode (Yes at step s601), the conveying speed at the time of reading by the spectral colorimeter 131 is switched according to the operating mode as illustrated in Table 5.

That is to say, the conveyance controller 106 is in the detecting unit correcting mode, so that this sets a rotational speed of a motor of the conveying roller 117 to the rotational speed with which the conveying speed is the conveying speed for correction.

TABLE 5

| CONVEYING SPEED SETTING | |
|---|---|
| OPERATING MODE | CONVEYING SPEED (mm/s) |
| NORMAL | 400 |
| CORRECTION | 200 |

s603: Set Normal Speed

When it is not in the detecting unit correcting mode (No at step s601), the conveyance controller 106 is in the normal mode, so that this sets the rotational speed of the motor of the colorimetric unit conveying roller 117 to the rotational speed with which the conveying speed is the normal conveying speed.

s604: Start Roller Operation

The conveyance controller 106 transmits an operating instruction to the motor of the colorimetric unit conveying roller 117 (step s604).

S605: Is Job Finished?

After the roller operation starts (step s604), the conveyance controller 106 confirms with the print controller 103 whether all sheets of the transfer paper are ejected and the print job is completed (step s605). When the job is not finished (No at step s605), this waits until the job is finished.

s606: Stop Roller

When the job is finished (Yes at step s605), the conveyance controller 106 transmits a stopping instruction to the motor of the colorimetric unit conveying roller 117 and waits for a next conveying instruction (to step s600).

Figure 9:
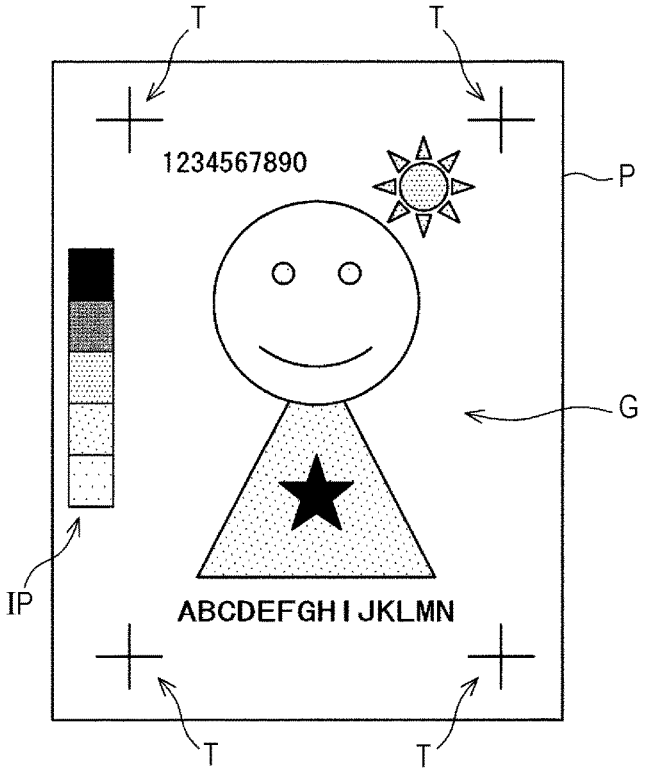
FIG. 9 is a view illustrating a transfer paper image in normal printing according to one embodiment of the present invention.

FIG. 9 is a view illustrating a transfer paper screen P on which the image patch for the image correction is generated at the time of normal printing. A normal screen G is formed and register marks T are formed on four corners on the transfer paper screen P. An image patch IP for the image correction is formed for each color in a margin area outside the register marks T. Since the margin area outside the register marks T is cut or the like, it is possible to form the image patch for the image formation without wasting a sheet.

FIG. 10 illustrates the transfer paper P on which an image patch SP for the detecting unit correction is formed; the image patch SP is formed for each color to have a sufficient size within an image forming area within the register marks T, so that it is possible to correct the line sensor with high accuracy.

In the above-described embodiment, it is possible to perform the colorimetry of the patch with high accuracy by using the spectral colorimeter to correct the line sensor with the small number of charts.

Second Embodiment

Meanwhile, although a straight path of a conveying path 115 provided with a line sensor 130 and a spectral colorimeter 131 is described in the above-described embodiment, it is also possible to convey transfer paper through a circulating path at the time of detecting unit correction. Meanwhile, the same reference numeral is assigned to a configuration similar to that of the above-described embodiment and the description thereof is omitted or simplified.

In an image forming system 1A of this embodiment, a circulating path 119 is branched from the conveying path 115 downstream of the spectral colorimeter 131 and a downstream side of the circulating path 119 joins the conveying path 115 upstream of the line sensor 130. A conveyance switcher 118 controlled by a conveyance controller 106 provided at a point at which the circulating path 119 branches switches a conveying direction of the transfer paper to the circulating path 119 in a first round of the detecting unit correction and switches the conveying direction of the transfer paper to a straight direction (paper ejecting path 115A side) in a second round. The conveying direction is set to the straight direction (paper ejecting path 115A side) at the time of normal printing.

A colorimetric unit conveying roller 117 is provided on the circulating path 119.

That is to say, the circulating path 119 for returning the transfer paper from a downstream side of the spectral colorimeter 131 to an upstream side of the line sensor 130 is provided and the colorimetric unit conveying roller 117 is provided in the circulating path 119 to decrease a transfer paper conveying speed.

In Normal Mode

The line sensor 130 reads but the spectral colorimeter 131 does not read the transfer paper when this passes through a calorimetric path 117A. A paper feeding path is switched to the paper ejecting path 115A and the transfer paper is ejected outside a device.

In Correcting Mode

The line sensor 130 reads but the spectral colorimeter 131 does not read the transfer paper in the first round in which this passes through the colorimetric path 117A. The paper feeding path is switched to the circulating path 119 by the conveyance switcher 118, the colorimetric unit conveying roller 117 decreases the conveying speed of the transfer paper, and thereafter the transfer paper is returned to a position between the line sensor 130 and a fixing unit to be read by the spectral colorimeter 131. The paper feeding path is switched to the paper ejecting path 115A and the transfer paper is ejected outside a device.

Meanwhile, a speed of a conveying motor of the colorimetric path 117A is the same as the conveying speed of a fixing device 114 in the first round and switched to the same conveying speed as that of the colorimetric unit conveying roller 117 for the reading in the second round at timing at which the transfer paper enters the circulating path 119.

In this embodiment, it is possible to keep a distance for changing the conveying speed by providing the circulating path 119 between the reading by the line sensor 130 and that by the spectral colorimeter 131, and a device width may be made smaller. Furthermore, it is possible to stop the colorimetric unit conveying roller 117 in the normal mode so as to prevent abrasion of the roller.

Meanwhile, as for a destination of the circulating path, the transfer paper may be returned to a position not between the line sensor and the fixing device but between the spectral colorimeter and the line sensor.

Furthermore, it is also possible to arrange the spectral colorimeter in the circulating path. In this case, there is an advantage that deterioration of the spectral colorimeter due to dirt by paper powder and heat of the transfer paper may be reduced in the normal mode in which the circulating path is not used.

Furthermore, it is possible to arrange the spectral colorimeter upstream of the line sensor. The spectral colorimeter is thermal-sensitive as compared to the line sensor, so that it is desirable to arrange the colorimeter downstream of the line sensor in consideration of an effect of heat at the time of fixing.

Furthermore, it is also possible to provide the colorimetric unit conveying roller between the spectral colorimeter and the circulating path.

Although it is configured that the spectral colorimeter is fixed in a central position, this may also be configured to move in a direction orthogonal to a paper feeding direction. That is to say, it becomes possible to read a patch in a central portion of the transfer paper in first paper feeding and read a patch on a right end after moving to the right end in second paper feeding after the circulation, thereby increasing the number of patches printable in one chart to decrease the number of sheets to be wasted.

It is also possible to provide a returning path in addition to the circulating path to read a rear surface after a front surface is read in a case of both-side printing. It is also possible to read by both the line sensor and the spectral colorimeter in the first and second rounds and discard a result with any one of conveying speeds.

Figure 12:
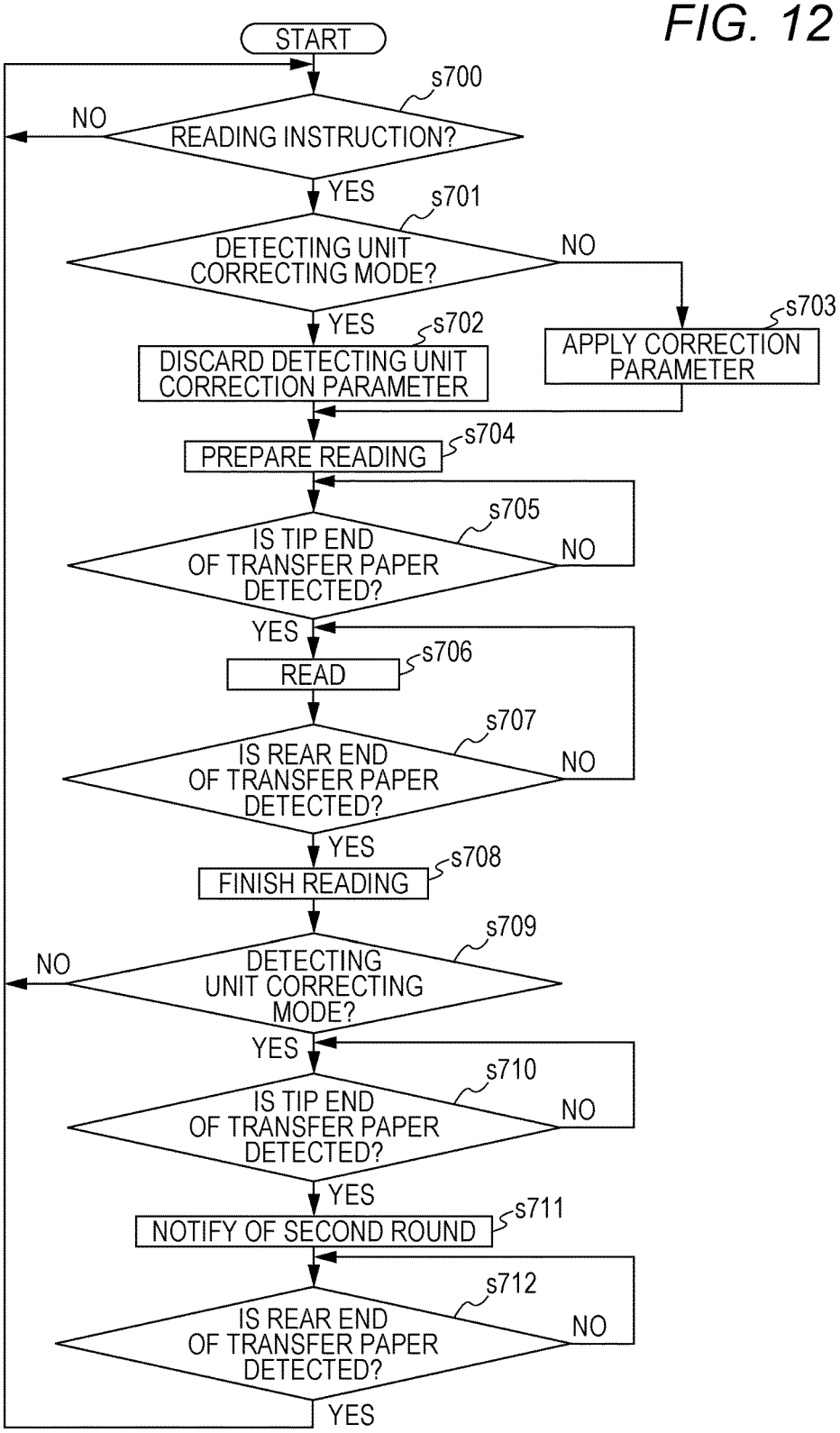
FIG. 12 is a flowchart illustrating a procedure of line sensor control according to another embodiment of the present invention.
Figure 13:
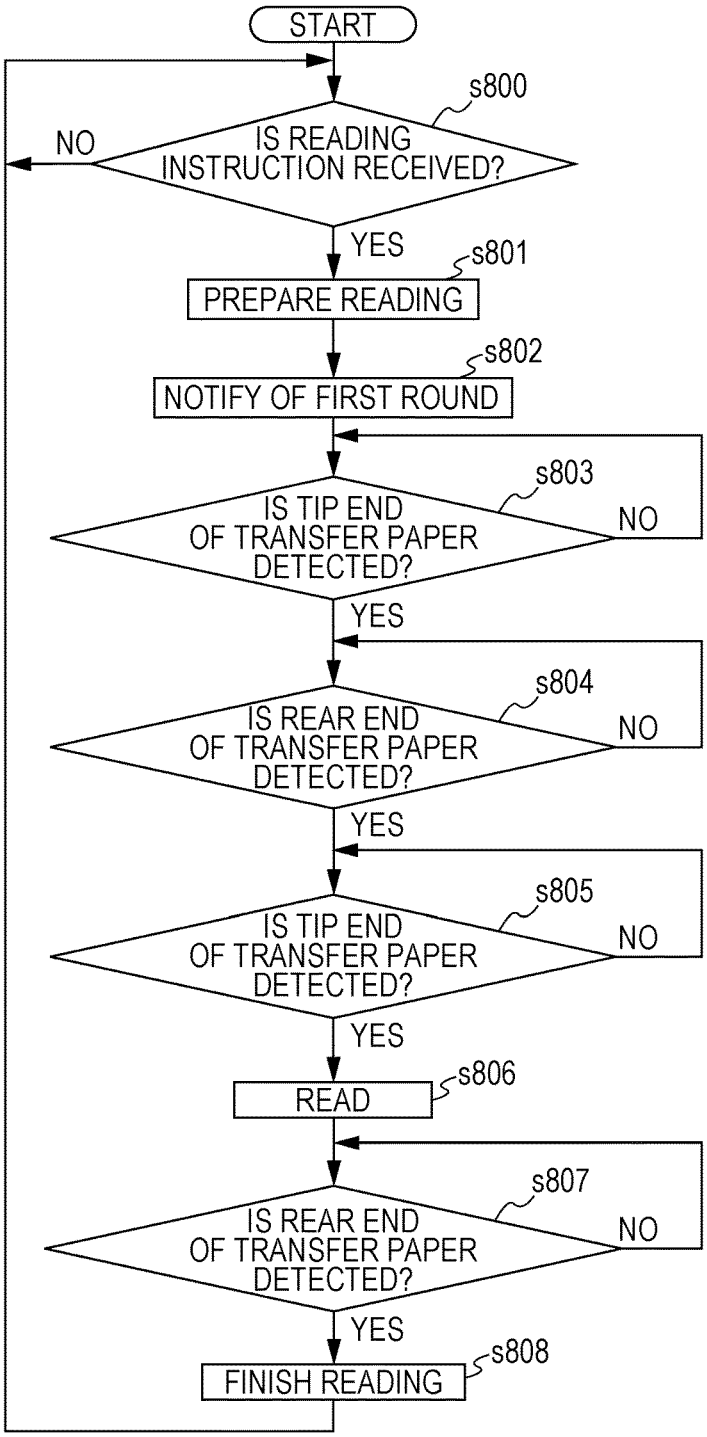
FIG. 13 is a flowchart illustrating a procedure of colorimeter control according to another embodiment of the present invention.

A processing procedure in a line sensor controller in the above-described embodiment is next described with reference to a flowchart in FIG. 12. Meanwhile, the following procedure is executed by control of a controller 100.

s700: Is Reading Instruction Received?

A line sensor controller 107 determines whether an instruction to read the transfer paper is received from a state managing unit 101 when a process starts (step s700). When there is no reading instruction (No at step s700), this waits until the instruction is issued.

s701: Detecting Unit Correcting Mode?

When there is the reading instruction (Yes at step s700), the line sensor controller 107 determines whether a current operating mode is a detecting unit correcting mode from the reading instruction received from the state managing unit 101 (step s701).

It is switched whether to apply a detecting unit correction parameter according to the operating mode as illustrated in Table 3.

s702: Discard Correction Parameter

In the detecting unit correcting mode (Yes at step s701), the line sensor controller 107 is in the detecting unit correcting mode, so that this sets the line sensor 130 in a through mode in which the correction parameter is not applied (step s702).

s703: Apply Correction Parameter

If it is not in the detecting unit correcting mode (No at step s701), the line sensor controller 107 is in the normal mode, so that this reads the correction parameter from a storage unit 102 to apply to the line sensor 130 (step s703). An example of the correction parameter is illustrated in Table 4.

s704: Prepare Reading

After steps s702 and s703, the line sensor controller 107 prepares reading based on information such as a transfer paper size and a patch position received in the reading instruction from the state managing unit 101 (step s704).

s705: Is Tip End of Transfer Paper Detected?

After preparing reading, the line sensor controller 107 confirms whether a line sensor unit transfer paper detecting sensor 130A is turned ON (step s705). This waits until the sensor is turned ON (No at step s705), and when the sensor is turned ON (Yes at step s705), this determines that a tip end of the transfer paper is detected to shift to a next process (step s706). In the second round, the line sensor controller 107 only confirms whether the transfer paper is fed and this does not perform reading operation.

s706: Read

When the tip of the transfer paper is detected (Yes at step s705), the line sensor controller 107 reads one line for each reading cycle in the first round (step s706).

s707: Is Rear End of Transfer Paper Detected?

After reading (step s706), the line sensor controller 107 confirms whether the line sensor unit transfer paper detecting sensor 130A is turned OFF (Yes at step s707). When the sensor is turned OFF, this determines that a rear end of the transfer paper is detected and shifts to a next process (step s708). When the sensor is not turned OFF (No at step s707), this waits for the detection (to step s706).

s708: Finish Reading

When the rear end of the transfer paper is detected (Yes at step s707), the line sensor controller 107 transmits a read image of the transfer paper to a correcting unit 109 through the state managing unit 101 and determines whether a next procedure is in the detecting unit correcting mode (step s709). When it is not in the detecting unit correcting mode (No at step s709), this waits for the reading instruction (to step s700).

In the detecting unit correcting mode (Yes at step s709), the line sensor controller 107 confirms whether the line sensor unit transfer paper detecting sensor 130A is turned ON (step s710). This waits until the sensor is turned ON (No at step s710), and when the sensor is turned ON (Yes at step s710), this determines that the tip end of the transfer paper is detected, the state managing unit 101 notifies the line sensor controller 107 of the second round (step s711), and the controller confirms whether the rear end of the transfer paper is detected, that is to say, whether the line sensor unit transfer paper detecting sensor 130A is turned OFF (step s712). This waits until the sensor is turned OFF (No at step s712), and when the sensor is turned OFF (Yes at step s712), this determines that the rear end of the transfer paper is detected and shifts to a next process (to wait for the reading instruction; step s700).

A controlling procedure of the colorimetry controller 108 in the above-described embodiment is next described. Meanwhile, the following procedure is executed by the control of the controller 100.

s800: Is Reading Instruction Received?

The colorimetry controller 108 determines whether there is the instruction to read the transfer paper from the state managing unit 101 (step s800). When there is no reading instruction, this waits until this is instructed (No at step s800).

s801: Prepare Reading

When there is the reading instruction (Yes at step s800), the colorimetry controller 108 prepares reading based on the information such as the transfer paper size and the patch position received in the reading instruction from the state managing unit 101 (step s801).

s802: Notify First Round

After preparing reading, the colorimetry controller 108 notifies the state managing unit 101 of start of the reading in the first round of the detecting unit correction (step s802).

S803: Is Tip End of Transfer Paper Detected?

After notifying of the first round, the colorimetry controller 108 confirms whether a colorimetric unit transfer paper detecting sensor 131A is turned ON (step s803). When the sensor is turned ON (Yes at step s803), this determines that the tip end of the transfer paper is detected and shifts to a next process. When the tip end of the transfer paper is not detected (No at step s803), the controller waits for the detection.

s804: Is Rear End of Transfer Paper Detected?

Then, the colorimetry controller 108 confirms whether the colorimetric unit transfer paper detecting sensor 131A is turned OFF (step s804). When the sensor is turned OFF (Yes at step s804), this determines that the rear end of the transfer paper is detected and shifts to a next process. When the rear end of the transfer paper is not detected (No at step s804), this waits for the detection.

s805: Is Tip End of Transfer Paper Detected?

The colorimetry controller 108 confirms whether the colorimetric unit transfer paper detecting sensor 131A is turned ON (step s805). When the sensor is turned ON (Yes at step s805), this determines that the tip end of the transfer paper is detected and shifts to a next process. When the tip end of the transfer paper is not detected (No at step s805), this waits for the detection.

s806: Read

When the tip end of the transfer paper is detected (Yes at step s805), the colorimetry controller 108 starts colorimetry when each patch position the reading instruction of which is issued comes (step s806).

s807: Is Rear End of Transfer Paper Detected?

The colorimetry controller 108 confirms whether the colorimetric unit transfer paper detecting sensor 131A is turned OFF. When the sensor is turned OFF, this determines that the rear end of the transfer paper is detected and shifts to a next process (step s808). When the sensor is not turned OFF (No at step s808), this waits for the detection.

s808: Finish Reading

After the rear end of the transfer paper is detected (step s807), the colorimetry controller 108 transmits a colorimetric value of each patch the reading instruction of which is issued to the correcting unit 109 through the state managing unit 101 and waits for the reading instruction (to step s800).

Figure 14:
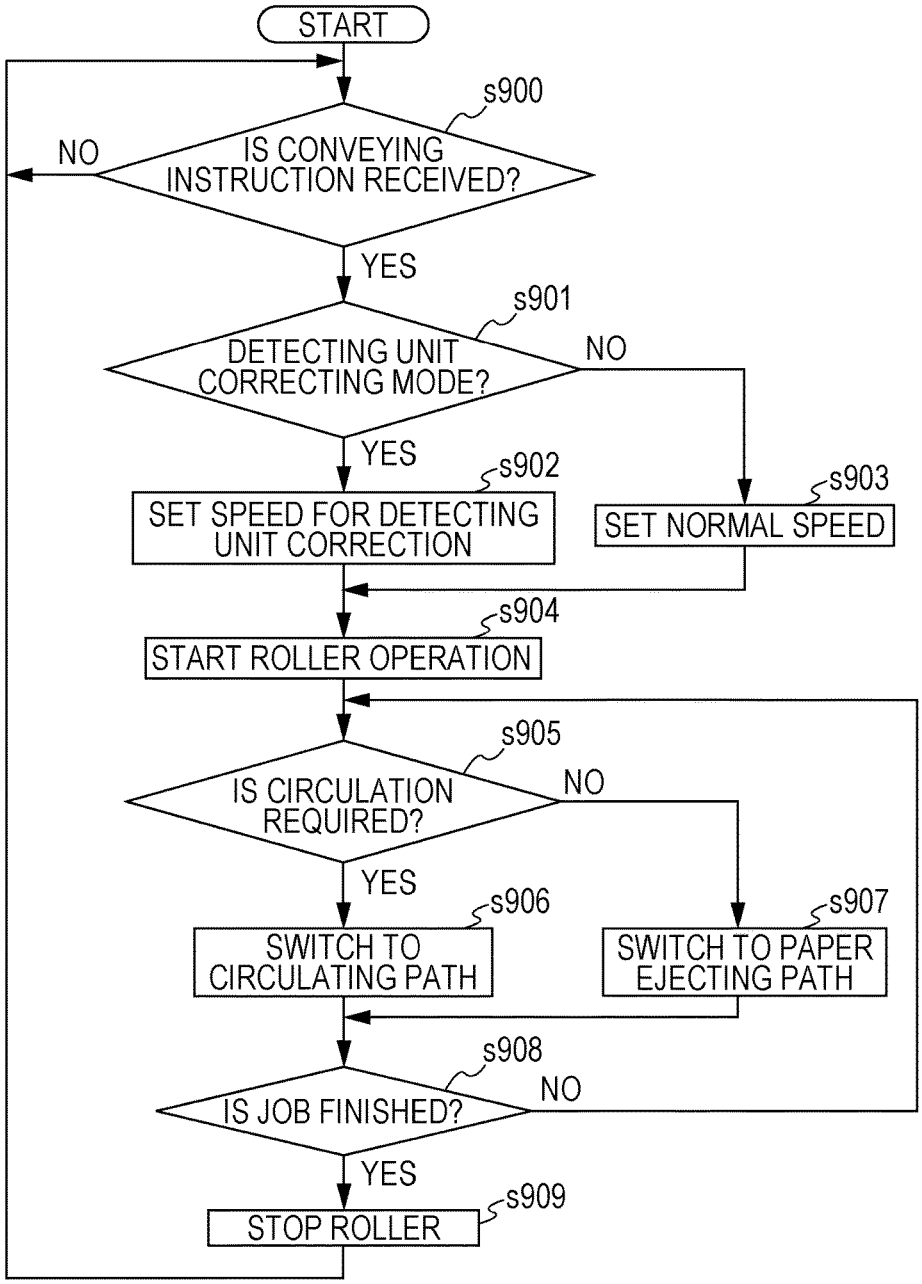
FIG. 14 is a flowchart illustrating a procedure of conveyance control according to another embodiment of the present invention.

A procedure of the conveyance controller is next described with reference to a flowchart in FIG. 14. Meanwhile, the following procedure is executed by the control of the controller 100.

s900: Is Conveying Instruction Received?

The conveyance controller 106 determines whether an instruction to feed the transfer paper is received from the state managing unit 101 when conveyance control starts (step s900). When there is no conveying instruction (No at step s900), this waits until this is instructed.

s901: Correcting Mode?

After receiving the conveying instruction (Yes at step s900), the conveyance controller 106 determines whether the current operating mode is the correcting mode from the paper feeding instruction received from the state managing unit 101 (step s901).

s902: Set Speed for Correction

In the detecting unit correcting mode (Yes at step s901), the conveying speed at the time of reading by the spectral colorimeter 131 is switched according to the operating mode as illustrated in Table 5.

That is to say, the conveyance controller 106 is in the detecting unit correcting mode, so that this sets a rotational speed of a motor of the conveying roller 117 to the rotational speed with which the conveying speed is the conveying speed for correction.

s903: Set Normal Speed

When it is not in the detecting unit correcting mode (No at step s901), the conveyance controller 106 is in the normal mode, so that this sets the rotational speed of the motor of the conveying roller 117 to the rotational speed with which the conveying speed is the normal conveying speed.

s904: Start Roller Operation

The conveyance controller 106 transmits an operating instruction to the motor of the colorimetric unit conveying roller 117 (step s904).

s905: Circulation is Required

After the operating instruction to the motor of the colorimetric unit conveying roller 117, the conveyance controller 106 determines whether it is required to switch to the circulating path. First, the conveyance controller 106 determines whether the current operating mode is the detecting unit correcting mode from the paper feeding instruction received from the state managing unit 101. In the normal mode, paper feeding to the circulating path is not required, so that this determines that the path is required to be switched to the paper ejecting path 115A.

In the detecting unit correcting mode, the conveyance controller 106 obtains correcting operation information indicating whether it is during the reading in the first round or that in the second round from the state managing unit 101. When the correcting operation information indicates the first round reading, this determines that it is required to switch to the circulating path 119 and the conveyance switcher 118 switches to the circulating path 119, and when the correcting operation information indicates the second round reading, this determines that it should be switched to the paper ejecting circuit 115A.

s906: Switch to Circulating Path

When circulation is required (Yes at step s905), the conveyance switcher 118 switches a convey destination to the circulating path 119.

s907: Switch to Paper Ejecting Path

When the circulation is not required (No at step s905), the conveyance switcher 118 switches the convey destination to the paper ejecting path 115A.

s908: Is Job Finished?

The conveyance controller 106 confirms with the print controller 103 whether all sheets of the transfer paper are ejected and the print job is completed (step s908). When the job is not finished (No at step s908), the procedure shifts to step s905 to determine whether the circulation is required.

s909: Stop Roller

When the job is finished (Yes at step s908), the conveyance controller 106 transmits an instruction to stop to the motor of the conveying roller 117 and waits for a next conveying instruction (to step s900).

Third Embodiment

Meanwhile, it is described that a line sensor reads while transfer paper is conveyed at a normal transfer paper conveying speed and a spectral colorimeter reads at the transfer paper conveying speed set to be lower at the time of detecting unit correction in the above-described embodiments. However, it is also possible to read while setting the conveying speeds lower in both detecting units at the time of the detecting unit correction in the present invention.

Figure 15:
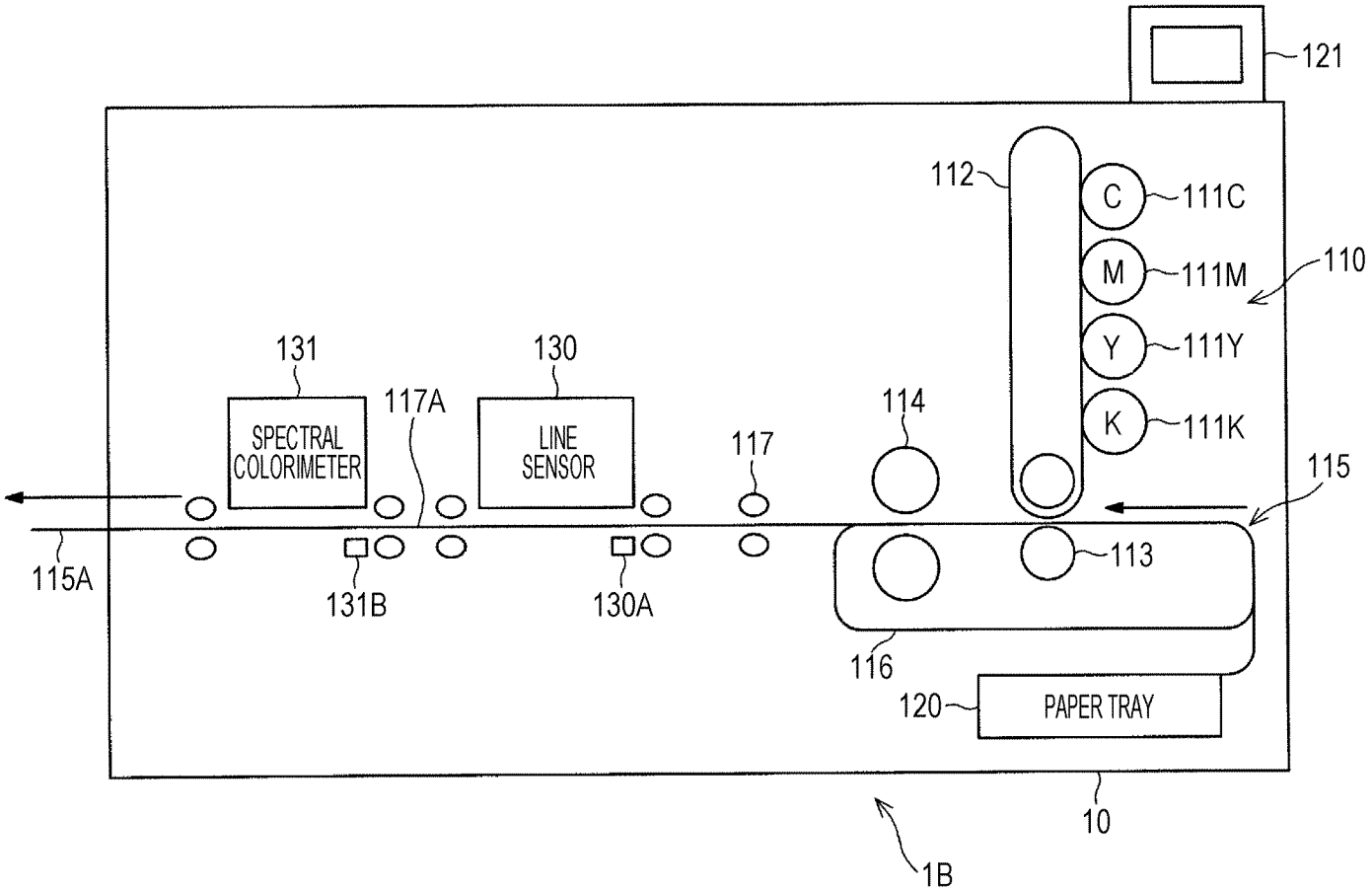
FIG. 15 is a view illustrating an image forming system according to still another embodiment of the present invention.

An image system 1B having a configuration of performing the above-described reading is illustrated in FIG. 15. Meanwhile, the same reference numeral is assigned to a configuration similar to that of the above-described embodiments and the description thereof is omitted or simplified.

On a conveying path 115, a colorimetric unit conveying roller 117 is located downstream of a fixing device 114, and a line sensor 130 and a spectral colorimeter 131 are arranged downstream thereof in this order. An upstream side of the spectral colorimeter 131 is assigned to a colorimetric path 117A. When the conveying speed is changed, the conveying speed of the paper in the line sensor 130 is also changed.

In the above-described image forming system 1B, in a detecting unit correcting mode, the conveying speed of the transfer paper is decreased by the colorimetric unit conveying roller 117 between the fixing device 114 and the line sensor 130, the line sensor 130 reads in a state in which the transfer paper conveying speed is decreased, the spectral colorimeter 131 next reads, and a paper ejecting path 115A ejects the transfer paper outside the device. Therefore, a read result of the line sensor 130 becomes prolonged data as it is.

In order to deal with this, it is possible to thin out the read result or change a reading cycle by the line sensor, for example.

Meanwhile, it is desirable to control a light amount such that a lamp light amount of the line sensor is not saturated according to a linear speed at the time of correction when thinning out and changing the reading cycle.

It is possible to make image resolution in a sub scanning direction in the correcting mode the same as that in a normal mode by thinning out the number of lines or prolonging the reading cycle, thereby reducing a memory area in which an image is saved.

It is possible to arrange the spectral colorimeter upstream of the line sensor also in this embodiment. However, the spectral colorimeter is thermal-sensitive as compared to the line sensor, so that it is desirable to arrange the colorimeter downstream of the line sensor in consideration of an effect of heat in fixing.

Figure 16:
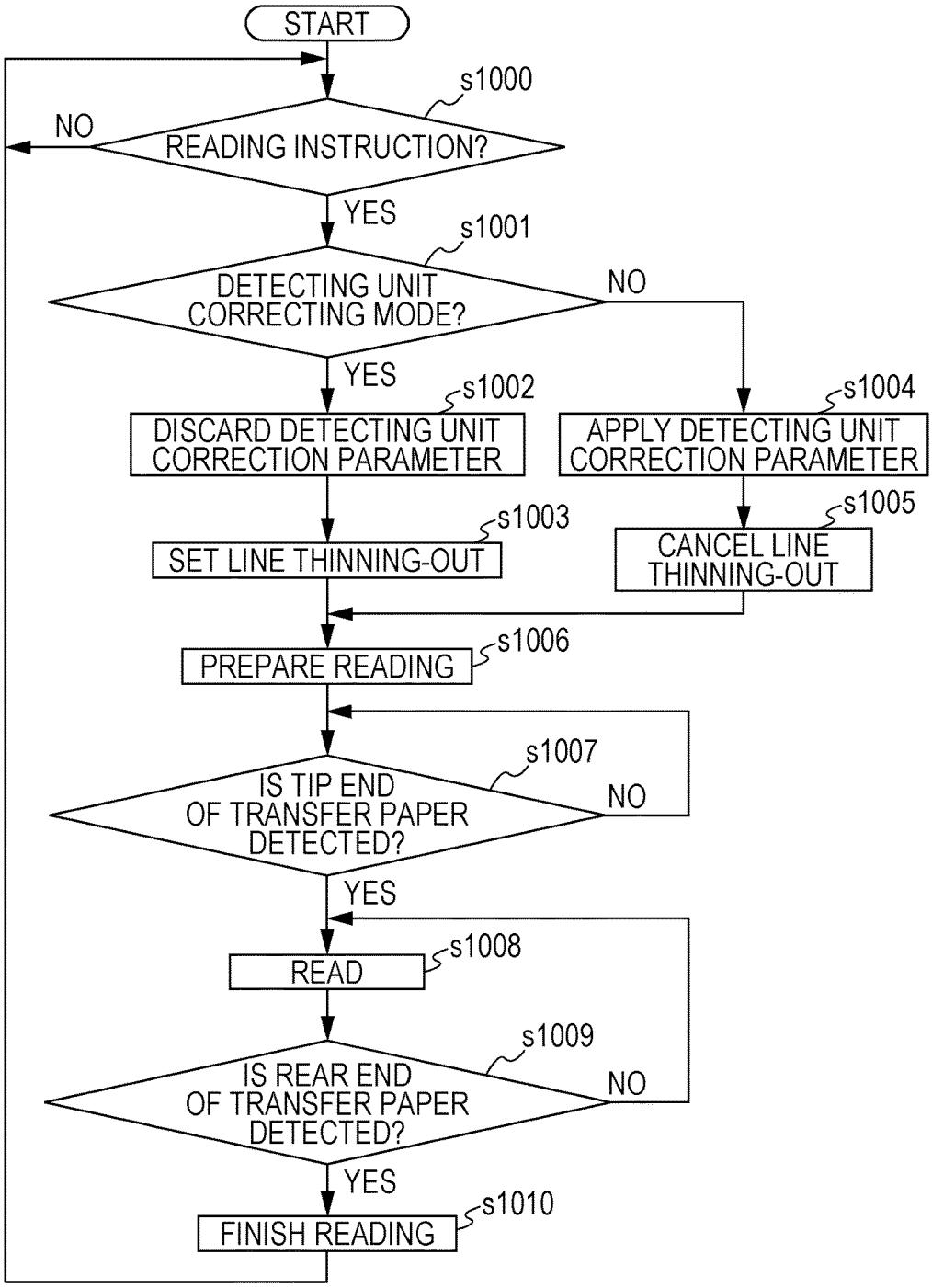
FIG. 16 is a flowchart illustrating a procedure of thinning out reading in line sensor control according to still another embodiment of the present invention.
Figure 17:
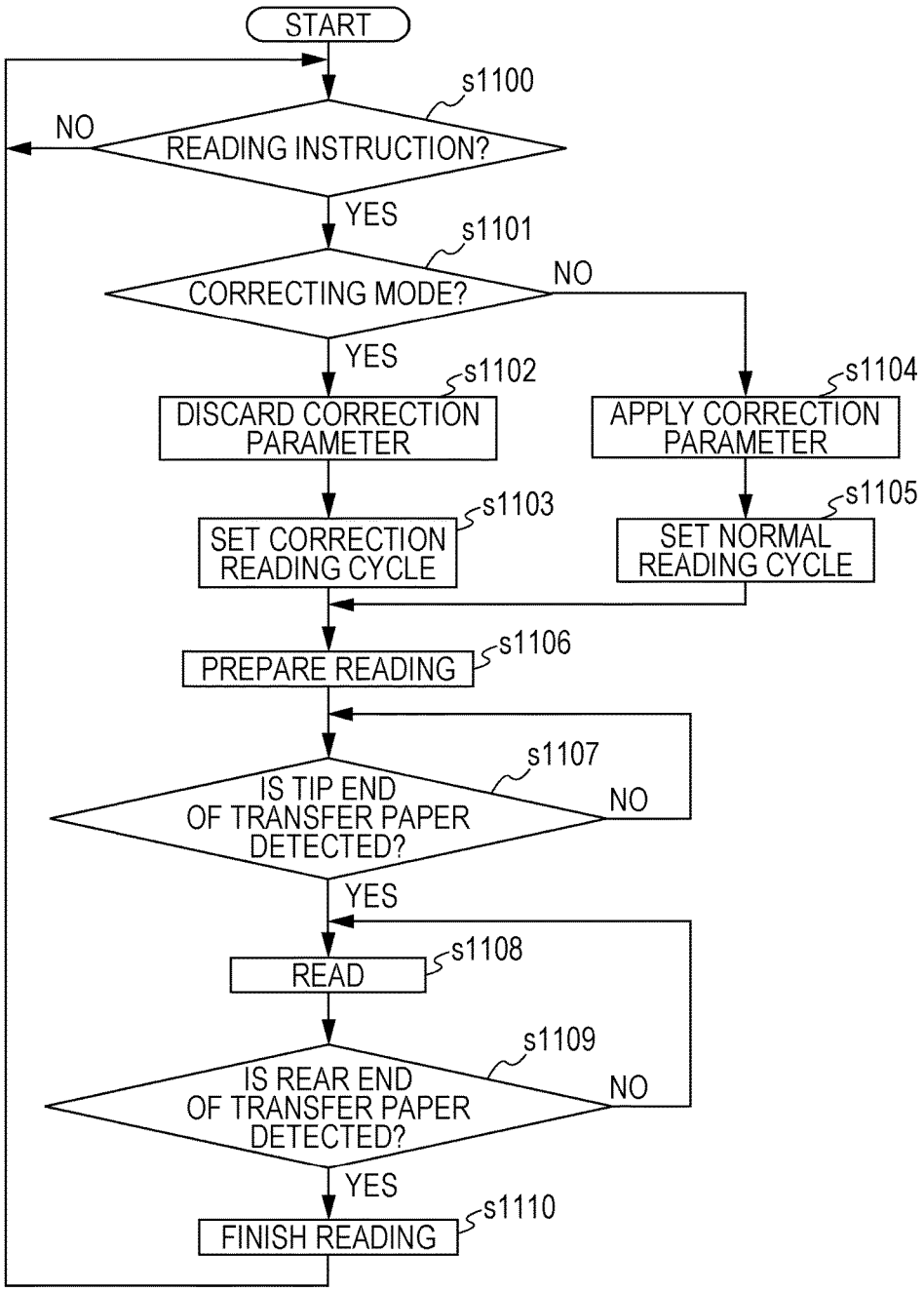
FIG. 17 is a flowchart illustrating a procedure of changing a reading cycle in the line sensor control according to still another embodiment of the present invention.

A controlling procedure in a line sensor controller 107 is hereinafter described with reference to a flowchart in FIG. 16 or 17.

Thinning-out of the read result is first described with reference to FIG. 16.

The line sensor controller 107 which controls the line sensor 130 further has a following function. (a) Thin Out Read Line It is set not to write the line in the memory after one line is read, thereby electrically thinning out sometimes.

It is also possible to generate an intermediate line from the read lines without simply thinning out; however this is an estimated value, so that this might cause a correction error. Therefore, it is desirable that a speed ratio between the normal mode and the correcting mode is set to 1:N.

s1000: Is Reading Instruction Received?

The line sensor controller 107 determines whether there is an instruction to read the transfer paper from a state managing unit 101 when the control starts (step s1000). When there is no reading instruction (No at step s1000), this waits for the instruction.

s1001: Detecting Unit Correcting Mode?

When there is the reading instruction (Yes at step s1000), the line sensor controller 107 determines whether a current operating mode is the detecting unit correcting mode from the read instruction received from the state managing unit 101 (step s1001).

It is switched whether to apply a detecting unit correction parameter according to the operating mode as illustrated in Table 3.

s1002: Discard Correction Parameter

In the detecting unit correcting mode (Yes at step s1001), the line sensor controller 107 is in the detecting unit correcting mode, so that this discards a correction parameter (step s1002) and sets the line sensor 130 in a through mode in which the correction parameter is not applied.

s1003: Set Line Thinning-Out

After the correction parameter is discarded (step s1002), the thinning-out at the time of the correction is set. For example, it is set to thin out an odd-numbered line or an even-numbered line. A thinning content may be set in advance to be stored in a storage unit 102 in a non-volatile manner.

For example, when the conveying speed in the normal mode and that in the correcting mode are 400 and 200 mm per second, respectively, as illustrated in Table 5, the speed ratio between the normal mode and the correcting mode is 1:2. Therefore, it is sufficient to thin out 50% of the read lines as illustrated in Table 6 in order to obtain the same image in the correcting mode (Table 6).

TABLE 6

| LINE THINNING-OUT OF LINE SENSOR | |
|---|---|
| OPERATING MODE | THINNING RATE (%) |
| NORMAL | 0 |
| CORRECTION | 50 |

s1004: Apply Correction Parameter

If it is not in the detecting unit correcting mode (No at step s1001), the line sensor controller 107 is in the normal mode, so that this reads an image correction parameter from the storage unit 102 to apply to the line sensor 130 (step s1003). An example of the correction parameter is illustrated in Table 4.

s1005: Cancel Line Thinning-Out

After the correction parameter is applied (step s1004), if the line thinning-out at the time of the correction is set, the line thinning-out is canceled and a normal thinning rate is set (step s1005).

s1006: Prepare Reading

After steps s1003 and s1005, the line sensor controller 107 prepares reading based on information such as a transfer paper size and a patch position received in the reading instruction from the state managing unit 101 (step s1006).

s1007: Is Tip End of Transfer Paper Detected?

After preparing reading, the line sensor controller 107 confirms whether a line sensor unit transfer paper detecting sensor 130A is turned ON (step s1007). This waits until the sensor is turned ON (No at step s1007), and when the sensor is turned ON (Yes at step s1007), this determines that a tip end of the transfer paper is detected to shift to a next process (step s1008).

s1008: Read

When the tip of the transfer paper is detected (Yes at step s1008), the line sensor controller 107 reads with the thinning rate set for each reading cycle (step s1008).

s1009: Is Rear End of Transfer Paper Detected?

After reading (step s1008), the line sensor controller 107 confirms whether the line sensor unit transfer paper detecting sensor 130A is turned OFF (Yes at step s1009). When the sensor is turned OFF, this determines that a rear end of the transfer paper is detected and shifts to a next process (step s1010). When the sensor is not turned OFF (No at step s1009), this waits for the detection (to step s1009).

s1010: Finish Reading

When the rear end of the transfer paper is detected (Yes at step s1009), the line sensor controller 107 transmits a read image of the transfer paper to a correcting unit 109 through the state managing unit 101 and waits for the reading instruction (to step s1000).

Next, a procedure of changing the reading cycle in the above-described embodiment is described with reference to a flowchart in FIG. 17.

An interval of reading of one line is adjusted in the detecting unit correcting mode to change the reading cycle. According to this, it is possible to obtain the same image as that in the normal mode.

s1100: Is Reading Instruction Received?

The line sensor controller 107 determines whether there is the instruction to read the transfer paper from the state managing unit 101 when the control starts (step s1100). When there is no reading instruction (No at step s1100), this waits for the instruction.

s1101: Detecting Unit Correcting Mode?

When there is the reading instruction (Yes at step s1100), the line sensor controller 107 determines whether the current operating mode is the detecting unit correcting mode from the reading instruction received from the state managing unit 101 (step s1101).

It is switched whether to apply the detecting unit correction parameter according to the operating mode as illustrated in Table 3.

s1102: Discard Correction Parameter

In the detecting unit correcting mode (Yes at step s1101), the line sensor controller 107 is in the detecting unit correcting mode, so that this discards the correction parameter (step s1102) and sets the line sensor 130 to the through mode in which the correction parameter is not applied.

s1103: Set Reading Cycle

After the correction parameter is discarded (step s1102), the reading cycle at the time of the correction is set. The reading cycle may be set in advance to be stored in the storage unit 102 in a non-volatile manner.

For example, when the speed ratio between the normal mode and the correcting mode is 1:2, if a clock of the line sensor in the normal mode is 60 MHZ, it is possible to obtain the same image as that in the normal mode by setting the clock to 30 MHz in the correcting mode as illustrated in an example in Table 7.

TABLE 7

| LINE SENSOR READING CYCLE (CCD CLOCK) | |
|---|---|
| OPERATING MODE | ONE LINE READING CYCLE (MHz) |
| NORMAL | 60 |
| CORRECTION | 30 |

s1104: Apply Correction Parameter

If it is not in the detecting unit correcting mode (No at step s1101), the line sensor controller 107 is in the normal mode, so that this reads the image correction parameter from the storage unit 102 to apply to the line sensor 130 (step s1004). An example of the correction parameter is illustrated in Table 4.

s1105: Set Normal Reading Cycle

After the correction parameter is applied (step s1104), the normal reading cycle is set (step s1105).

s1106: Prepare Reading

After steps s1103 and s1105, the line sensor controller 107 prepares reading based on the information such as the transfer paper size and the patch position received in the reading instruction from the state managing unit 101 (step s1106).

s1107: Is Tip End of Transfer Paper Detected?

After preparing reading, the line sensor controller 107 confirms whether the line sensor unit transfer paper detecting sensor 130A is turned ON (step s1107). This waits until the sensor is turned ON (No at step s1107), and when the sensor is turned ON (Yes at step s1107), this determines that the tip end of the transfer paper is detected to shift to a next process (step s1108).

s1108: Read

When the tip end of the transfer paper is detected (Yes at step s1108), the line sensor controller 107 reads with the set reading cycle (step s1108).

s1109: Is Rear End of Transfer Paper Detected?

After reading (step s1108), the line sensor controller 107 confirms whether the line sensor unit transfer paper detecting sensor 130A is turned OFF (Yes at step s1109). When the sensor is turned OFF, this determines that a rear end of the transfer paper is detected and shifts to a next process (step s1010). When the sensor is not turned OFF (No at step s1109), this waits for the detection (to step s1109).

s1110: Finish Reading

When the rear end of the transfer paper is detected (Yes at step s1109), the line sensor controller 107 transmits the read image of the transfer paper to the correcting unit 109 through the state managing unit 101 and waits for the reading instruction (to step s1100).

Meanwhile, although the spectral colorimeter located in the image forming unit or the image forming system is described in the above-described embodiments, it is also possible that a posteriorly fitted colorimetric device including the spectral colorimeter is connected to the image forming device or the image forming system to form an image forming system 1C including the spectral colorimeter.

Figure 18:
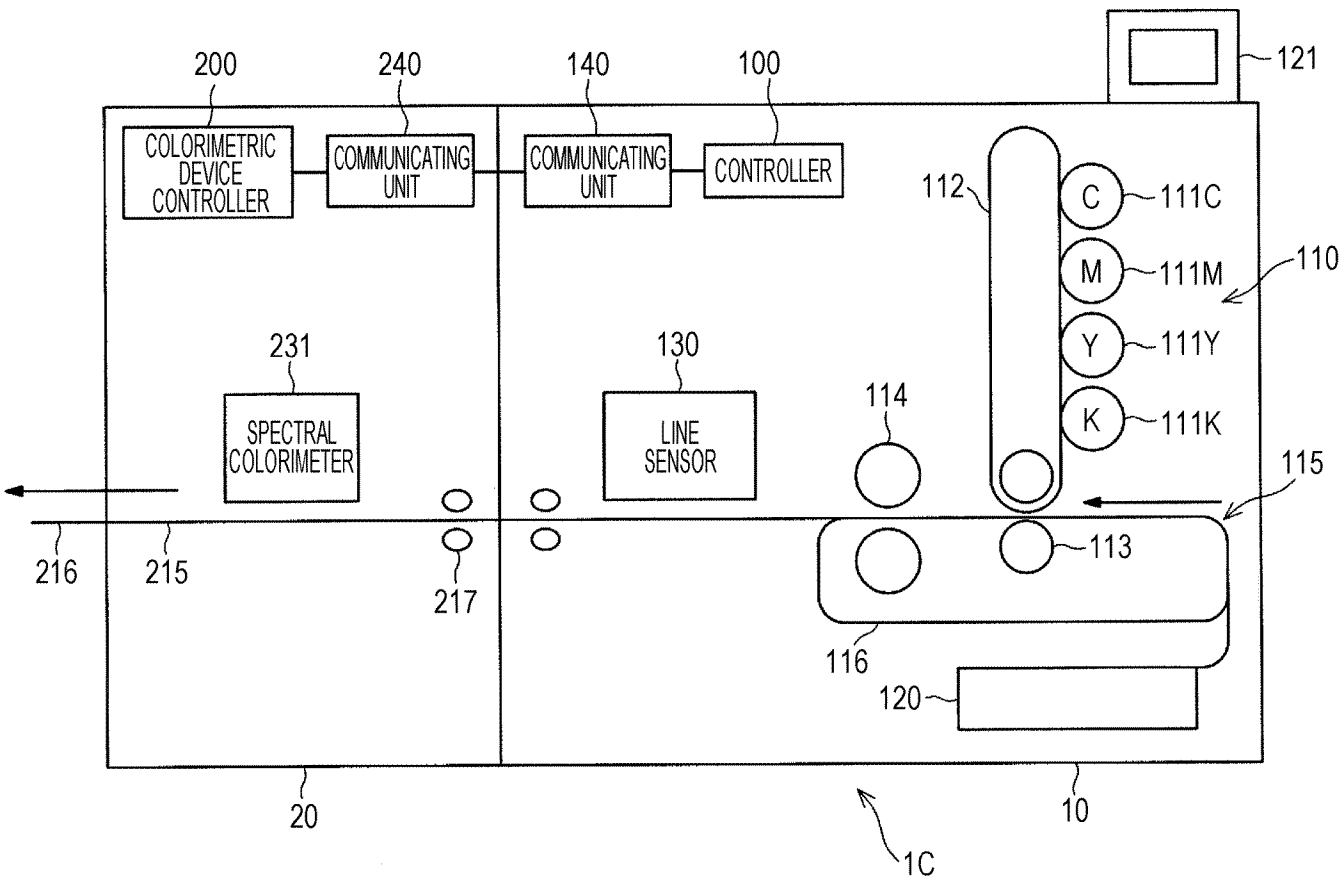
FIG. 18 is a view illustrating an example of using a colorimetric device according to still another embodiment of the present invention.

Such colorimetric device is described with reference to FIG. 18.

A colorimetric device 20 may be mechanically/electrically posteriorly fitted to an image forming device 10 and includes a conveying path 215 connected to a conveying path 115. A communicating unit 140 is provided on the image forming device 10 and a communicating unit 240 is provided on the colorimetric device 20 such that they may be connected to each other so as to be communicable. The communicating unit 140 is connected to a controller 100 provided on the image forming device 10 so as to be controllable, and the communicating unit 240 is connected to a colorimetric device controller 200 which controls an entire colorimetric device 20 so as to be controllable. A line sensor 130 corresponding to a first image detecting unit is located on the conveying path 115 in the image forming device 10.

The colorimetric device 20 corresponds to an image detecting device of the present invention and the colorimetric device controller corresponds to a detecting device controller.

In the colorimetric device 20, a spectral colorimeter 231 corresponding to a second image detecting unit is arranged on the conveying path 215 and a colorimetric unit conveying roller 217 is provided on the conveying path 215 upstream of the spectral colorimeter 231. The colorimetric unit conveying roller 217 is connected to the colorimetric device controller 200 so as to be controllable and this may decrease the conveying speed of the transfer paper to be conveyed on a downstream side.

The system configured in the above-described manner provides notification of the mode in the image forming device 10 through the communicating unit 140 to decrease the transfer paper conveying speed by the colorimetric unit conveying roller 217 and reads the image on the transfer paper by the spectral colorimeter 231 in the detecting unit correcting mode. The read transfer paper is ejected outside the colorimetric device 20 through a paper ejecting path 216. Meanwhile, a post processing device and the like may also be connected downstream of the colorimetric device 20. A read result read by the spectral colorimeter 231 may be transmitted to the controller 100 through the communicating units 240 and 140 to be used in correction of the line sensor 130. Meanwhile, in this embodiment, the controller 100 and the colorimetric device controller 200 cooperate to serve as the controller of the invention of the present application.

Although it is described that the line sensor is provided on the image forming device 10 and the spectral colorimeter is provided on the colorimetric device 20 in the above-described embodiment, both the line sensor and the spectral colorimeter may be provided on the colorimetric device. In the detecting unit correcting mode, in the colorimetric device which receives a mode instruction from the image forming device or in colorimetric device's own mode setting, it is possible to read the same image by the line sensor and the colorimetric device and transmit the read results to the image forming device to calculate the correction value, or it is possible to correct the line sensor based on the read result by the colorimetric device controller.

Meanwhile, although the line sensor is illustrated as the first image detecting unit and the spectral colorimeter is illustrated as the second image detecting unit in the above-described embodiments, the types of the image detecting units are not limited to the above; the first and second image detecting units may be the same type with different accuracy. Although it is described that the conveying speed of the transfer paper is made lower than usual when the second image detecting unit reads the image in the above-described embodiments, it is also possible to change the transfer paper conveying speed such that the image reading by the second image detecting unit is faster than usual at the time of the reading by the second image detecting unit.

Although the present invention has been described above based on the above-described embodiments, appropriate change may be made without departing from the scope of the present invention.

According to an embodiment of the present invention, it is possible to apply an appropriate transfer paper conveying speed for the image reading by the second image detecting unit and correct the first image detecting unit while inhibiting generation of a wasted sheet by using the read result of the second image detecting unit with the small number of charts.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming device comprising:

an image forming unit configured to form an image on transfer paper;

a conveying unit configured to convey the transfer paper through a conveying path;

a first image detecting unit configured to detect the image on the transfer paper on which the image is formed by the image forming unit conveyed by the conveying unit;

a second image detecting unit formed of a detecting unit other than the first image detecting unit configured to detect the image on the transfer paper on which the image is formed by the image forming unit conveyed by the conveying unit; and a controller configured to control image formation and conveyance of the transfer paper and receive detection results of the first and second image detecting units, wherein the controller includes a detecting unit correcting mode in which the first image detecting unit is corrected by using an image detection result by the second image detecting unit, and in the detecting unit correcting mode, a transfer paper conveying speed including a speed of a trailing end of the transfer paper at a time of image reading by the second image detecting unit is changed to a transfer paper conveying speed different from a normal transfer paper conveying speed at a time of image formation, and the first image detecting unit is corrected based on read results of the same image output by the first and second image detecting units.

2. The image forming device according to claim 1, wherein the controller includes an image formation correcting mode in which an image forming condition by the image forming unit is amended by using at least the read results output by the first image detecting unit.

3. The image forming device according to claim 1, wherein the controller sets the transfer paper conveying speed at a time of the image reading by the first image detecting unit to be the same transfer paper conveying speed as the normal transfer paper conveying speed at the time of the image formation in an image formation correcting mode.

4. The image forming device according to claim 1, comprising:

a conveying speed changing unit configured to change the transfer paper conveying speed at the time of the image reading by the second image detecting unit.

5. The image forming device according to claim 4, wherein the conveying speed changing unit is arranged downstream of the first image detecting unit on the conveying path, and the controller changes the transfer paper conveying speed by the conveying speed changing unit before the second image detecting unit reads the image.

6. The image forming device according to claim 4, wherein the conveying speed changing unit is arranged upstream of the first image detecting unit on the conveying path, and the controller changes the transfer paper conveying speed by the conveying speed changing unit before the second image detecting unit reads the image.

7. The image forming device according to claim 1, wherein the conveying unit includes a circulation conveying path on a downstream side of the conveying path on which one or both of the first and second image detecting units are arranged, the circulation conveying path configured to return the transfer paper to an upstream side of the conveying path to convey, and the controller executes control to convey the transfer paper through the circulation conveying path after reading the image by at least one of the first and second image detecting units on the conveying path and read the image by at least one of the first and second image detecting units which does not read the image.

8. The image forming device according to claim 1, wherein the controller reads the image on the transfer paper while changing a reading cycle of the first image detecting unit in the detecting unit correcting mode.

9. The image forming device according to claim 1, wherein the controller thins out read data by the first image detecting unit in the detecting unit correcting mode.

10. The image forming device according to claim 1, wherein the first image detecting unit is arranged upstream of the second image detecting unit on the path on which the transfer paper is conveyed.

11. The image forming device according to claim 1, wherein the first image detecting unit is arranged downstream of the second image detecting unit on the path on which the transfer paper is conveyed.

12. The image forming device according to claim 1, wherein the first image detecting unit is a line sensor.

13. The image forming device according to claim 1, wherein the second image detecting unit is a spectral colorimeter.

14. The image forming device according to claim 1, wherein the first image detecting unit is a line sensor configured to detect line data about the image.

15. The image forming device according to claim 1, wherein the second image detecting unit is a spectral colorimeter.

16. An image forming system comprising:

an image forming unit configured to form an image on transfer paper;

a conveying unit configured to convey the transfer paper through a conveying path;

a first image detecting unit configured to detect the image on the transfer paper on which the image is formed by the image forming unit conveyed by the conveying unit;

a second image detecting unit formed of a detecting unit other than the first image detecting unit configured to detect the image on the transfer paper on which the image is formed by the image forming unit conveyed by the conveying unit; and a controller configured to control image formation and conveyance of the transfer paper and receive detection results of the first and second image detecting units, wherein the controller includes a detecting unit correcting mode in which the first image detecting unit is corrected by using an image detection result by the second image detecting unit, and in the detecting unit correcting mode, a transfer paper conveying speed including a speed of a trailing end of the transfer paper at a time of image reading by the second image detecting unit is changed to a transfer paper conveying speed different from a normal transfer paper conveying speed at a time of image formation, and the first image detecting unit is corrected based on read results of the same image output by the first and second image detecting units.

17. The image forming system according to claim 16, wherein the controller includes an image formation correcting mode in which an image forming condition by the image forming unit is amended by using at least the read results output by the first image detecting unit.

18. The image forming system according to claim 16, wherein the controller sets the transfer paper conveying speed at a time of the image reading by the first image detecting unit to be the same transfer paper conveying speed as the normal transfer paper conveying speed at the time of the image formation in an image formation correcting mode.

19. The image forming system according to claim 16, wherein the first image detecting unit is a line sensor configured to detect line data about the image.

20. The image forming system according to claim 16, wherein the second image detecting unit is a spectral colorimeter.

21. An image detecting unit correcting method comprising:

an image forming step of forming an image on transfer paper;

a first image detecting step of detecting the image on conveyed transfer paper by a first image detecting unit;

a second image detecting step of detecting the image on the conveyed transfer paper by a second image detecting unit;

a conveying speed changing step of changing a conveying speed including a speed of a trailing end of the transfer paper conveyed at the second image detecting step to a transfer paper conveying speed different from a normal transfer paper conveying speed at a time of image formation; and a detecting unit correcting step of correcting the first image detecting unit based on read results of the same image output at the first and second image detecting steps.

22. An image detecting device connected downstream of an image forming device in a transfer paper conveying direction, the image detecting device comprising:

a conveying unit configured to convey transfer paper on which an image is formed conveyed from the image forming device through a conveying path;

a second detecting unit out of a first image detecting unit configured to detect the image on the transfer paper conveyed by the conveying unit and the second image detecting unit formed of a detecting unit other than the first image detecting unit configured to detect the image on the transfer paper conveyed by the conveying unit;

a conveying speed changing unit configured to change a transfer paper conveying speed including a speed of a trailing end of the transfer paper when the second image detecting unit reads the image; and a detecting device controller configured to control the conveying speed changing unit, wherein the detecting device controller changes the transfer paper conveying speed including a speed of the trailing end of the transfer paper when the second image detecting unit reads the image to a transfer paper conveying speed different from a normal transfer paper conveying speed in the image forming device.

23. The image detecting device according to claim 22, wherein the detecting device controller changes the transfer paper conveying speed in response to an instruction of a controller provided on the image forming device.

24. The image detecting device according to claim 22, comprising:

a detecting device communicating unit configured to communicate with the image forming device, wherein the detecting device controller transmits an image detection result by at least the second image detecting unit out of the first and second image detecting units obtained by the image detecting device to the image forming device through the detecting device communicating unit.

25. The image detecting device according to claim 22, wherein the image detecting device is connected to the image forming device provided with the first image detecting unit.

26. The image detecting device according to claim 22, comprising:

the first image detecting unit, wherein the detecting device controller corrects the first image detecting unit read results of the same image output by the first and second image detecting units.

* * * * *